US008583266B2

(12) United States Patent
Herbrich et al.

(10) Patent No.: US 8,583,266 B2
(45) **Date of Patent: *Nov. 12, 2013**

(54) SEEDING IN A SKILL SCORING FRAMEWORK

(75) Inventors: Ralf Herbrich, Cambridge (GB); Thore K. H. Graepel, Cambridge (GB)

(73) Assignee: Microsoft Corporation, Redmond, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/412,509

(22) Filed: Mar. 5, 2012

(65) Prior Publication Data

US 2012/0221129 A1 Aug. 30, 2012

Related U.S. Application Data

(63) Continuation of application No. 11/540,195, filed on Sep. 29, 2006, now Pat. No. 8,175,726, which is a continuation-in-part of application No. 11/276,184, filed on Feb. 16, 2006, now Pat. No. 7,376,474, which is a continuation of application No. 11/041,752, filed on Jan. 24, 2005, now Pat. No. 7,050,868.

(51) Int. Cl.
*A63F 9/24* (2006.01)

(52) U.S. Cl.
USPC ..... 700/93

(58) Field of Classification Search
USPC ..... 463/93
See application file for complete search history.

(56) References Cited

U.S. PATENT DOCUMENTS

| | | | |
|---|---|---|---|
| 5,221,082 | A | 6/1993 | Curshod |
| 5,830,064 | A | 11/1998 | Bradish et al. |
| 5,853,324 | A | 12/1998 | Kami |
| 5,916,024 | A | 6/1999 | Von Kohorn |
| 6,074,312 | A | 6/2000 | Lyon et al. |
| 6,174,237 | B1 | 1/2001 | Stephenson |

(Continued)

FOREIGN PATENT DOCUMENTS

| | | |
|---|---|---|
| EP | 1 862 955 | 12/2007 |
| JP | 2000-508940 | 7/2000 |

(Continued)

OTHER PUBLICATIONS

Genz, A.; "Numerical Computation of Multivariate Normal Probabilities"; Journal of Computational and Graphical Statistics 1; 1992; pp. 141-149.

(Continued)

*Primary Examiner* — Corbett B Coburn

(57) ABSTRACT

Skill scores represent a ranking or other indication of the skill of the player based on the outcome of the game in a gaming environment. Skills scores can be used in matching compatible players on the same team and matching opposing players or teams to obtain an evenly-matched competition. An initial skill score of a player in a new gaming environment may be based in whole or in part on the skill score of that player in another game environment. The influence that the skill scores for these other game environments may have in the skill score seeding for the new game environment may be weighted based on a defined compatibility factor with the new game environment. The compatibility factor can be determined based on a game-to-game basis, compatible categories or features, game developer defined parameters, or any combination of considerations.

21 Claims, 11 Drawing Sheets

(56) References Cited

U.S. PATENT DOCUMENTS

| | | | | |
|---|---|---|---|---|
| 6,267,687 | B1 | 7/2001 | Alex | |
| 6,443,838 | B1 | 9/2002 | Jaimet | |
| 6,468,155 | B1 | 10/2002 | Zucker | |
| 6,523,828 | B2 | 2/2003 | Lorenzin | |
| 6,801,810 | B1 | 10/2004 | Poncet | |
| 6,824,462 | B2 | 11/2004 | Lydon et al. | |
| 6,840,861 | B2 | 1/2005 | Jordan et al. | |
| 6,895,385 | B1 | 5/2005 | Zacharia et al. | |
| 6,996,444 | B2 | 2/2006 | Ach | |
| 7,050,868 | B1 | 5/2006 | Graepel et al. | |
| 7,376,474 | B2 | 5/2008 | Graepel et al. | |
| 1,406,430 | A1 | 7/2008 | Reisman | |
| 7,416,489 | B2 * | 8/2008 | Smith, III | 463/42 |
| 7,519,562 | B1 | 4/2009 | Vander Mey et al. | |
| 7,587,367 | B2 | 9/2009 | Mengerink | |
| 7,793,205 | B2 | 9/2010 | Errico et al. | |
| 7,840,288 | B2 | 11/2010 | Graepel et al. | |
| 7,846,024 | B2 | 12/2010 | Graepel et al. | |
| 8,010,459 | B2 | 8/2011 | Buyukkokten | |
| 8,175,726 | B2 | 5/2012 | Herbrich | |
| 2002/0046041 | A1 | 4/2002 | Lang | |
| 2002/0068592 | A1 | 6/2002 | Hutcheson et al. | |
| 2002/0115488 | A1 | 8/2002 | Berry et al. | |
| 2002/0116325 | A1 | 8/2002 | Wise | |
| 2003/0073472 | A1 | 4/2003 | Varley | |
| 2003/0158827 | A1 | 8/2003 | Ansari | |
| 2004/0059655 | A1 | 3/2004 | Seifert et al. | |
| 2004/0083078 | A1 | 4/2004 | Feldman | |
| 2004/0225387 | A1 | 11/2004 | Smith, III | |
| 2005/0087926 | A1 | 4/2005 | Hattori | |
| 2005/0091077 | A1 | 4/2005 | Reynolds | |
| 2005/0192097 | A1 | 9/2005 | Farnham et al. | |
| 2005/0233791 | A1 | 10/2005 | Kane | |
| 2006/0042483 | A1 | 3/2006 | Work et al. | |
| 2006/0178765 | A1 | 8/2006 | Graepel | |
| 2006/0184260 | A1 | 8/2006 | Graepel | |
| 2007/0026934 | A1 | 2/2007 | Herbrich | |
| 2007/0078675 | A1 | 4/2007 | Kaplan | |
| 2007/0112706 | A1 | 5/2007 | Herbrich | |
| 2007/0124579 | A1 | 5/2007 | Haller | |
| 2007/0129133 | A1 | 6/2007 | Bansemer | |
| 2007/0166680 | A1 | 7/2007 | Shibata et al. | |
| 2007/0191110 | A1 | 8/2007 | Crouse | |
| 2007/0192169 | A1 | 8/2007 | Herbrich | |
| 2009/0227313 | A1 | 9/2009 | Minka | |

FOREIGN PATENT DOCUMENTS

| | | |
|---|---|---|
| JP | 2000-262766 | 9/2000 |
| JP | 2001-526550 | 12/2001 |
| JP | 2002-035432 | 2/2002 |
| JP | 2002-140455 | 5/2002 |
| JP | 2003-500129 | 1/2003 |
| JP | 2003-117243 | 4/2003 |
| JP | 2004-041719 | 2/2004 |
| JP | 2004-209299 | 7/2004 |
| JP | 2004-298234 | 10/2004 |
| JP | 2004-329949 | 11/2004 |
| JP | 2006-204921 | 8/2006 |
| KR | 10-20000053909 | 9/2000 |
| KR | 2001-0069675 | 7/2001 |
| KR | 2002-0003634 | 1/2002 |
| KR | 2005-0095667 | 9/2005 |
| WO | WO02/077897 | 10/2002 |
| WO | WO2004/017178 | 2/2004 |
| WO | WO 2007/094909 | 8/2007 |

OTHER PUBLICATIONS

Glickman, M.; "The Glicko System"; Boston University; http://www.glicko.net/glicko/glicko.doc/glicko.html; 1999.

Glickman, M.; "Parameter Estimation in Large Dynamic Paired Comparison Experiments"; Applied Statistics; vol. 48; 1999; p. 377-394.

Glickman, M.; "Examples of the Glicko-2 System"; Boston University; http://www.glicko.net/glicko/glicko2.doc/example.html; 1999.

Heckerman, D.; "A Tutorial on Learning With Bayesian Networks"; Mar. 1995; Microsoft Research; pp. 1-57.

Minka, T.: "A Family of Algorithms for Approximate Bayesian Inference"; Ph.D. Thesis; Jan. 12, 2001; Massachusetts Institute of Technology; Boston, MA; pp. 1-75.

Mitchell et al.; "Six in the City: Introducing Real Tournament—A Mobile IPv6 Based Context-Aware Multiplayer Game"; Proceedings of the 2nd Workshop on Network and System Support for Games, NETGAMES 2003; May 22-23, 2003; Redwood City, California; pp. 91-100.

Press, William H., et al.; Numerical Recipes in C: the Art of Scientific Computing (2d. ed.); Cambridge, U.K.; Cambridge University Press; 1988.

Scheid, F., "The Search for the Perfect Handicap"; 1978 Winter Simulation Conference; vol. 2; Dec. 1978; pp. 889-896.

Shehory, O. et al.; "Multi-Agent Coalition Re-Formation and League Ranking"; Autonomous Agents and Multiagent Systems Conference; vol. 3; 2004; pp. 1346-1347.

Wikipedia; "ELO rating system; http://en.wikipedia.org/wiki/ELO_rating_system"; downloaded Jan. 4, 2005.

Wikipedia; "Handicapping Golf; http//en.wikipedia.org/wiki/Handicap_(golf)"; downloaded Mar. 26, 2010.

Winn, J.; "Variational Message Passing and its Applications"; St. John's College, Cambridge, U.K.; Jan. 2004; pp. 1-149.

International Search Report and Written Opinion for PCT/US2007/004136 dated Jul. 19, 2007.

International Search Report and Written Opinion for PCT/US2007/001096 dated Jul. 9, 2007.

International Search Report and Written Opinion for PCT/US2006/045159 dated Apr. 16, 2007.

JP Patent Application 2006-015483; Office Actions dated Feb. 23, 2007; Sep. 18, 2007; Jan. 29, 2008 (English translations only).

CN Patent Application 200680043271.9; Office Actions dated Aug. 11, 2010; Mar. 23, 2011 (and English translations).

CN Patent Application 200780005935.7; Office Action dated Mar. 23, 2011 (and English translation).

CN Patent Application 200780005036.7; Office Actions dated Dec. 31, 2010; Dec. 31, 2011 (and English translations).

David, "The Method of Paired Comparisons", pp. 1386-1387, Hafner Publishing Company, 1963.

EP Communication for Application No. 06270014.1-2221, Reference P/10816.96EP, Jul. 11, 2008.

EP Communication for Application No. 06270014.1, Reference P/10816.96EP, Aug. 4, 2006.

EP Commencement of Proceedings Before the Board of Appeal for Application No. 06270014.1-2221/1862955, Reference P/10816.96EP, Jan. 19, 2010.

EP Decision to Refuse for Application No. 06270014.1-2221, Reference P/10816.96EP, Nov. 11, 2009.

EP Grounds of Appeal for Application No. 06270014.1, Dec. 22, 2009.

EP Notice of Appeal for Application No. 06270014.1, Dec. 17, 2009.

EP Office Action Response for Application No. 06270014.1, Aug. 6, 2009.

EP Office Action Response for Application No. 06270014.1, Dec. 30, 2008.

EP Result of Consultation for Application No. 06270014.1-2221, Reference P/10816.96EP, Jul. 1, 2009.

EP Summons to Attend or Proceedings for Application No. 06270014.1-2221/1862955. Reference P/10816.96EP, May 8, 2009.

Glickman, "A Comprehensive Guide to Chess Ratings", 1995.

KR Notice of Preliminary Rejection for Application No. 10-2008-7019513, Feb. 8, 2013.

PCT International Preliminary Report and Written Opinion for Application No. PCT/US2007/001096, Aug. 21, 2008.

Allen, "Collective Choice: Competitive Ranking Systems", Publicly Archived on or before Jan. 17, 2006.

Edwards, "Edo Historical Ches Ratings", Aug. 30, 2006.

Herbrich, "TrueSkill: A Bayesian Skill Rating System", Jun. 2006.

(56) References Cited

OTHER PUBLICATIONS

Hosobuchi, "A Note on the Improvement of a Fast Correlation Attack on Stream Ciphers", The IEICE Transactions on Fundamentals of Electronics, Communications and Computer Sciences, Feb. 2006.
Knies "TrueSkill: Matchmaking Made Easy for Xbox Live", Nov. 21, 2005.
Perry, "Live in the Next Generation: The TrueSkill System", Oct. 28, 2005.
Sonas, "Chessmetrics", Mar. 26, 2005.
Bolton, "How Effective Are Electronic Reputation Mechanisms? An Experimental Investigation", Management Science, Nov. 2004.
Song, "Trusted P2P Transactions With Fuzzy Reputation Aggregation", IEEE Internet Computing, Nov. 2005.
EP Communication for Application No. 06100075.8-1238, Reference EP37943TE900kap, Apr. 24, 2007.
EP Communication for Application No. 06100075.8 Reference EP37943TE900kap, May 26, 2006.
EP Decision of Technical Board of Appeal for Application No. 06100075.8/1684228, Reference EP37943TE900kap, Apr. 19, 2013.
EP Decision of Technical Board of Appeal for Application No. 06270014.1/1862955, Reference P/10816.96EP, Apr. 19, 2013.
EP Decision to Refuse for Application No. 06 100 075.8-2221, Reference EP37943TE900kap, Jan. 20, 2010.
EP Minutes of the Public Oral Proceedings for Application No. 06270014.1/1862955, Reference P/10816.96EP, Mar. 5, 2013.
EP Provision of the Minutes for Application No. 06 100 075.8-2221 Reference EP37943TE900kap, Jan. 20, 2010.
Graepel, "Bayesian Scoring", U.S. Appl. No. 11/041,752, filed Jan. 24, 2005.
Graepel, "Bayesian Scoring", U.S. Appl. No. 11/276,184, filed Feb. 16, 2006.
Graepel, "Player Ranking with Partial Information", U.S. Appl. No. 11/276,226, filed Feb. 17, 2006.
Herbrich, "Seeding in a Skill Scoring Framework", U.S. Appl. No. 11/540,195, filed Sep. 29, 2006.
EP Communication for Application No. 06838224.9-2221/1958140 PCT/US2006045159, Reference EP58247TE900aha, Jan. 7, 2013.
Graepel, "Team Matching", U.S. Appl. No. 60/739,072, filed Nov. 21, 2005.
Harris, "Microsoft Paper Reveals TrueSkill of Gamers", Nov. 1, 2005.
KR Reasons for Rejection for Application No. 10-2008-7011949, Mar. 25, 2013.

* cited by examiner

SEEDING IN A SKILL SCORING FRAMEWORK

CROSS-REFERENCE TO RELATED APPLICATIONS

This application is a continuation of U.S. patent application Ser. No. 11/540,195, filed Sep. 29, 2006, which is a continuation-in-part of U.S. patent application Ser. No. 11/276,184, entitled "Bayesian Scoring," filed on Feb. 16, 2006, and now U.S. Pat. No. 7,376,474, which is a continuation of U.S. patent application Ser. No. 11/041,752, entitled "Bayesian Scoring" and filed on Jan. 24, 2005, now U.S. Pat. No. 7,050,868, all of which are specifically incorporated herein for all that they disclose and teach.

BRIEF DESCRIPTIONS OF THE DRAWINGS

The foregoing aspects and many of the attendant advantages of the described technology will become more readily appreciated as the same become better understood by reference to the following detailed description, when taken in conjunction with the accompanying drawings, wherein.

DETAILED DESCRIPTIONS

Exemplary Operating Environment

Figure 1:
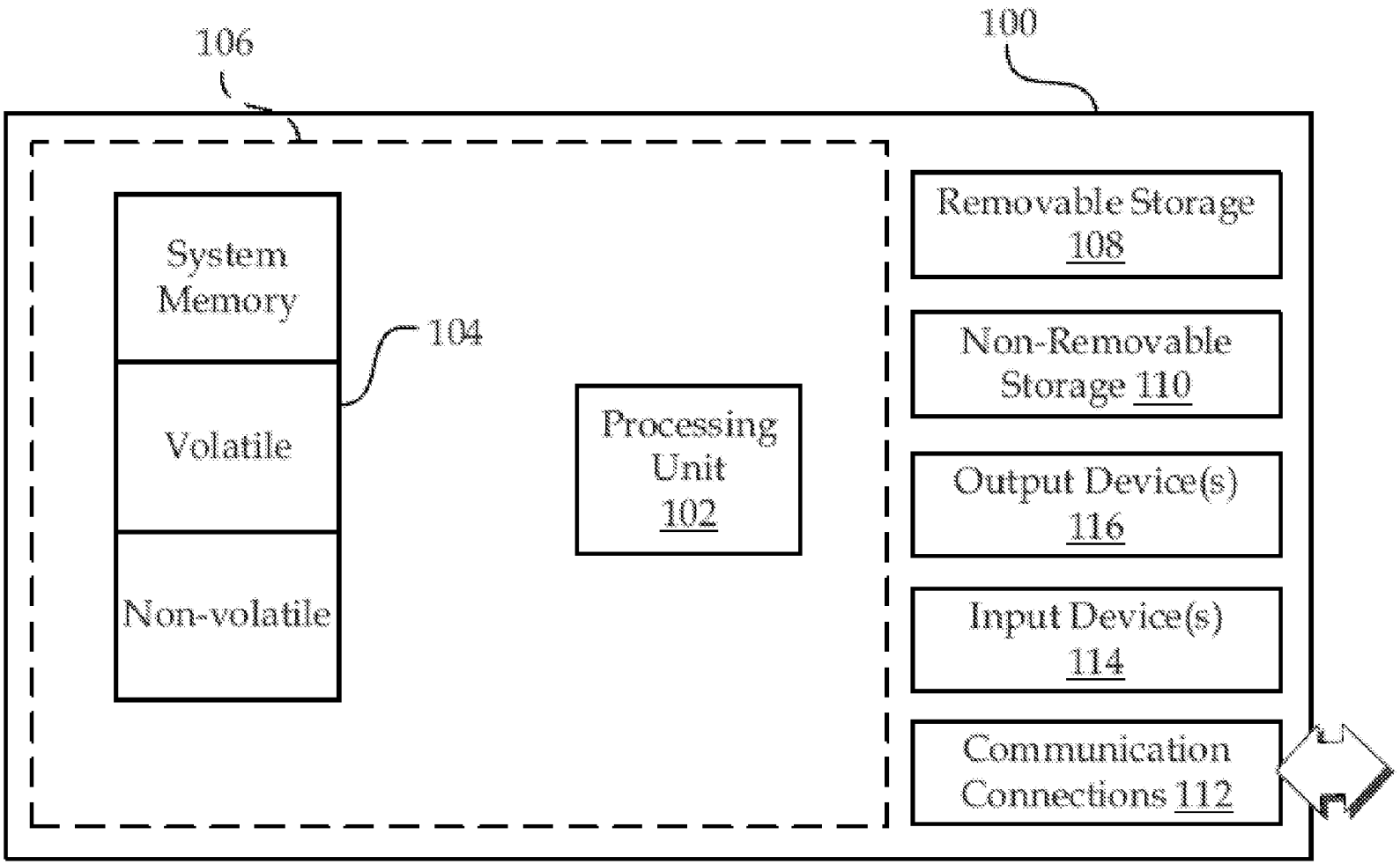
FIG. 1 is an example computing system for implementing a skill scoring system.

FIG. 1 and the following discussion are intended to provide a brief, general description of a suitable computing environment in which a skill scoring system may be implemented. The operating environment of FIG. 1 is only one example of a suitable operating environment and is not intended to suggest any limitation as to the scope of use or functionality of the operating environment. Other well known computing systems, environments, and/or configurations that may be suitable for use with a skill scoring system described herein include, but are not limited to, personal computers, server computers, hand-held or laptop devices, multiprocessor systems, micro-processor based systems, programmable consumer electronics, network personal computers, mini computers, mainframe computers, distributed computing environments that include any of the above systems or devices, and the like.

Although not required, the skill scoring system will be described in the general context of computer-executable instructions, such as program modules, being executed by one or more computers or other devices. Generally, program modules include routines, programs, objects, components, data structures, etc. that perform particular tasks or implement particular abstract data types. Typically, the functionality of the program modules may be combined or distributed as desired in various environments.

With reference to FIG. 1, an exemplary system for implementing a skill scoring system includes a computing device, such as computing device 100. In its most basic configuration, computing device 100 typically includes at least one processing unit 102 and memory 104. Depending on the exact configuration and type of computing device, memory 104 may be volatile (such as RAM), non-volatile (such as ROM, flash memory, etc.) or some combination of the two. This most basic configuration is illustrated in FIG. 1 by dashed line 106. Additionally, device 100 may also have additional features and/or functionality. For example, device 100 may also include additional storage (e.g., removable and/or non-removable) including, but not limited to, magnetic or optical disks or tape. Such additional storage is illustrated in FIG. 1 by removable storage 108 and non-removable storage 110. Computer storage media includes volatile and nonvolatile, removable and non-removable media implemented in any method or technology for storage of information such as computer readable instructions, data structures, program modules, or other data. Memory 104, removable storage 108, and non-removable storage 110 are all examples of computer storage media. Computer storage media includes, but is not limited to, RAM, ROM, EEPROM, flash memory or other memory technology, CD-ROM, digital versatile disks (DVDs) or other optical storage, magnetic cassettes, magnetic tape, magnetic disk storage or other magnetic storage devices, or any other medium which can be used to store the desired information and which can be accessed by device 100. Any such computer storage media may be part of device 100.

Device 100 may also contain communication connection(s) 112 that allow the device 100 to communicate with other devices. Communications connection(s) 112 is an example of communication media. Communication media typically embodies computer readable instructions, data structures, program modules or other data in a modulated data signal such as a carrier wave or other transport mechanism and includes any information delivery media. The term 'modulated data signal' means a signal that has one or more of its characteristics set or changed in such a manner as to encode information in the signal. By way of example, and not limitation, communication media includes wired media such as a wired network or direct-wired connection, and wireless media such as acoustic, radio frequency, infrared, and other wireless media. The term computer readable media as used herein includes both storage media and communication media.

Device 100 may also have input device(s) 114 such as keyboard, mouse, pen, voice input device, touch input device, laser range finder, infra-red cameras, video input devices, and/or any other input device. Output device(s) 116 such as display, speakers, printer, and/or any other output device may also be included.

Skill Scoring System

Players in a gaming environment, particularly electronic on-line gaming environments, may be skill scored relative to each other or to a predetermined skill scoring system. As used herein, the skill score of a player is not a 'game score' that a player achieves by gaining points or other rewards within a game; but rather, a ranking or other indication of the skill of the player based on the outcome of the game. It should be appreciated that any gaming environment may be suitable for use with the skill scoring system described further below. For example, players of the game may be in communication with a central server through an on-line gaming environment, directly connected to a game console, play a physical world game (e.g., chess, poker, tennis), and the like.

The skill scoring may be used to track a player's progress and/or standing within the gaming environment, and/or may be used to match players with each other in a future game. For example, players with substantially equal skill scores, or skill scores meeting predetermined and/or user defined thresholds, may be matched as opponents to form a substantially equal challenge in the game for each player.

The skill scoring of each player may be based on the outcomes of games among players who compete against each other in teams of one or more. The outcome of each game may update the skill score of each player participating in that game. The outcome of a game may be indicated as a particular winner, a ranked list of participating players, and possibly ties or draws. Each player's skill score on a numerical scale may be represented as a distribution over potential skill scores which may be parameterized for each player by an average skill score $\mu$ and a skill score variance $\sigma^2$. The variance may indicate a confidence level in the distribution representing the player's skill score. The skill score distribution for each player may be modeled with a Gaussian distribution and may be determined through a Bayesian inference algorithm.

Figure 2:
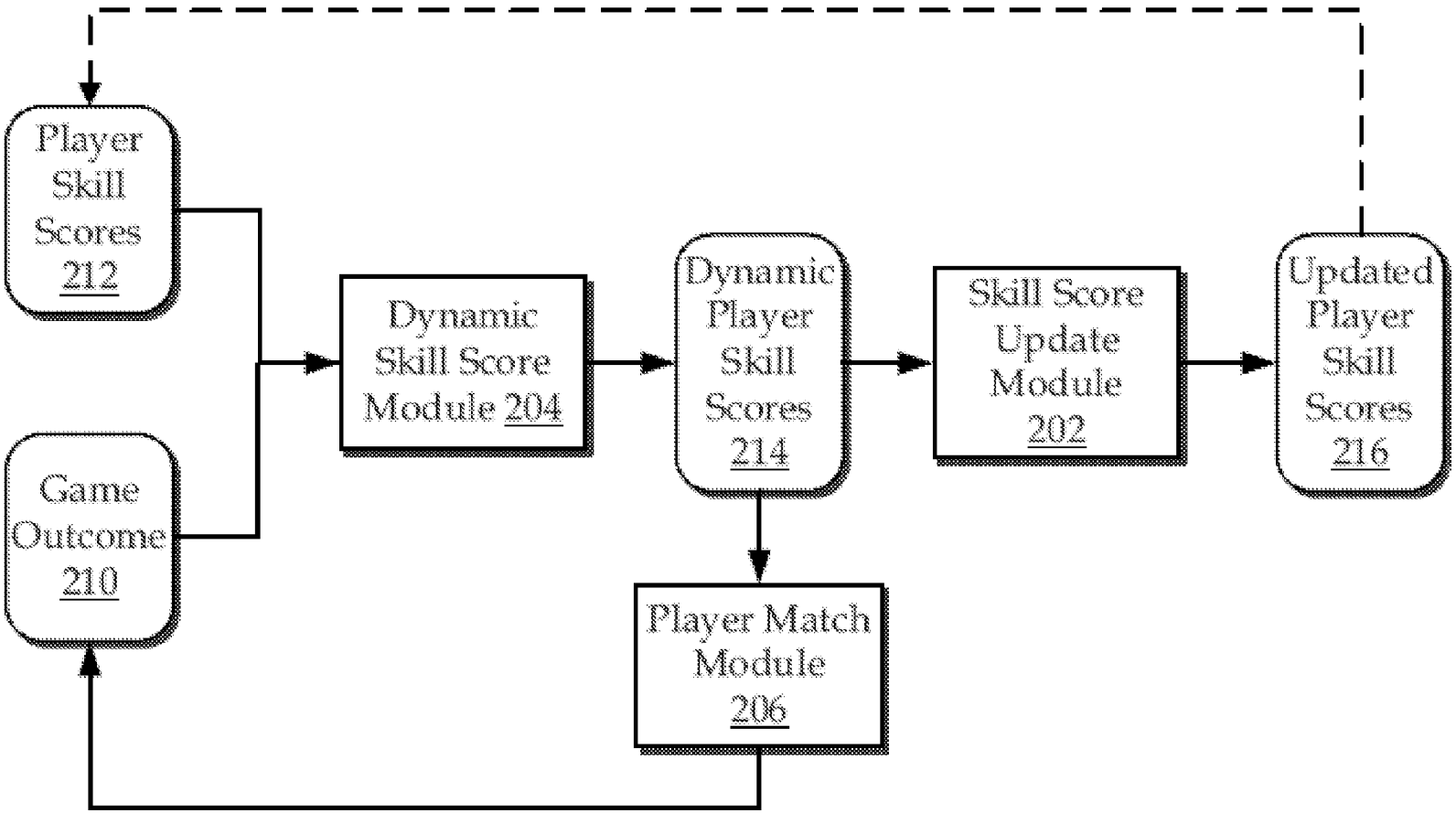
FIG. 2 is a dataflow diagram of an example skill scoring system.

FIG. 2 illustrates an example skill scoring system for determining skill scores for multiple players. Although the following example is discussed with respect to one player opposing another single player in a game to create a game outcome, it should be appreciated that following examples will discuss a team comprising one or more players opposing another team, as well as multi-team games. The skill scoring system 200 of FIG. 2 includes a skill score update module 202 which accepts the outcome 210 of a game between two or more players. It should be appreciated that the game outcome may be received through any suitable method. For example, the outcome may be communicated from the player environment, such as an on-line system, to a central processor to the skill scoring system in any suitable manner, such as through a global communication network. In another example, the skill scores of the opposing player(s) may be communicated to the gaming system of a player hosting the skill scoring system. In this manner, the individual gaming system may receive the skill scores of the opposing players in any suitable manner, such as through a global communication network. In yet another example, the skill scoring system may be a part of the gaming environment, such as a home game system, used by the players to play the game. In yet another example, the game outcome(s) may be manually input into the skill scoring system if the gaming environment is unable to communicate the game outcome to the skill scoring system, e.g., the game is a 'real' world game such as board chess.

The game outcome 210 may be an identification of the winning team, the losing team, and/or a tie. For example, if two players (player A and player B) oppose one another in a game, the game outcome may be one of three possible results, player A wins and player B loses; player A loses and player B wins; and players A and B draw. Each player has a skill score 212 which may be updated to an updated skill score 216 in accordance with the possible change over time due to player improvement (or unfortunate atrophy) and the outcome of the game by both the dynamic skill score module 214 and the skill score update module 202. More particularly, where the player skill score 212 is a distribution, the mean and variance of each player's skill score may be updated in view of the outcome and the possible change over time due to player improvement (or unfortunate atrophy). The dynamic skill score module 204 allows the skill score 212 of one or more players to change over time due to player improvement (or unfortunate atrophy). The skill score update module 202, through the outcomes of games, learns the skill score of the player. The player may improve over time, thus, the mean may be increased and/or the variance or confidence in the skill score may be broadened. In this manner, the skill score of each player may be modified to a dynamic player skill score 214 to allow for improvement of the players. The dynamic player skill scores 214 may then be used as input to the skill score update module 202. In this manner, the skill score of each player may be learned over a sequence of games played between two or more players.

The skill score of each player may be used by a player match module 206 to create matches between players based upon factors such as player indicated preferences and/or skill score matching techniques. The matched players, with their dynamic player skill scores 214 may then oppose one another and generate another game outcome 210.

In some cases, to accurately determine the ranking of a number n of players, at least log(n!), or approximately n log(n) game outcomes may be evaluated. The base of the logarithm depends on the number of unique game outcomes between the two players. In this example, the base is three since there are three possible game outcomes (player A wins, player A lose, and draw). This lower bound of evaluated outcomes may be attained only if each of the game outcomes is fully informative, that is, a priori, the outcomes of the game have a substantially equal probability. Thus, in many games, the players may be matched to have equal strength to increase the knowledge attained from each game outcome. Moreover, the players may appreciate a reasonable challenge from a peer player.

It is to be appreciated that although the dynamic skill score module 204, the skill score update module 202, the player match module 206 are discussed herein as separate processes within the skill scoring system 200, any function or component of the skill scoring system 200 may be provided by any of the other processes or components. Moreover, it is to be appreciated that other skill scoring system configurations may be appropriate. For example, more than one dynamic skill scoring module, skill score update module, skill score vector, and/or player match module may be provided. Likewise, more than one database may be available for storing skill score, rank, and/or game outcomes. Any portion of the modules of the skill scoring system may be hard coded into software supporting the skill scoring system, and/or any portion of the skill scoring system 200 may provided by any computing system which is part of a network or external to a network.

Learning Skill Scores

In a two player game, the outcomes may be player A wins, player A loses, or players A and B draw. The outcome of the game may be indicated in any suitable manner such as through a ranking of the players for that particular game. In accordance with the game outcome, each player of a game may be ranked in accordance with a numerical scale. For example, the rank $r_i$ of a player may have a value of 1 for the winner and a value of 2 for a loser. In a tie, the two players will have the same rank.

A player's skill score $s_i$ may indicate the player's standing relative to a standard scale and/or other players. The skill score may be individual to one or more people acting as a player, or to a game type, a game application, and the like. The skill score $s_i$ of each player may have a stochastic transitive property. More particularly, if player i is skill scored above player j, then player i is more likely to win against player j as opposed to player j winning against player i. In mathematical terms:

$$s_i \geq s_j \rightarrow P(\text{player } i \text{ wins}) \geq P(\text{player } j \text{ wins}) \quad (1)$$

This stochastic transitive property implies that the probability of player i winning or drawing is greater than or equal to one half because, in any game between two players, there are only three mutually exclusive outcomes (player i wins, loses, or draws).

To estimate the skill score for each player such as in the skill score update module 202 of FIG. 2, a Bayesian learning methodology may be used. With a Bayesian approach, the belief in the true skill score $s_i$ of a player may be indicated as a probability density of the skill score (i.e., P(s)). In the following examples, the probability density of the skill score representing the belief in the true skill score is selected as a Gaussian with a mean μ and a diagonal covariance matrix (diag($\sigma^2$)). The Gaussian density may be shown as:

$$P(s)=N(s;\mu,\text{diag}(\sigma^2)) \quad (2)$$

Selecting the Gaussian allows the distribution to be unimodal with mode μ. In this manner, a player should not be expected to alternate between widely varying levels of play. Additionally, a Gaussian representation of the skill score may be stored efficiently in memory. In particular, assuming a diagonal covariance matrix effectively leads to allowing each individual skill score for a player i to be represented with two values: the mean $\mu_i$ and the variance $\sigma_i^2$.

The initial and updated skill scores (e.g., mean μ and variance $\sigma^2$) of each player may be stored in any suitable manner. For example, the mean and variance of each player may be stored in separate skill score vectors, e.g., a mean vector μ and variance vector $\sigma^2$, a data store, and the like. If all the means and variances for all possible players are stored in vectors, e.g., μ and $\sigma^2$, then the update equations may update only those means and variances associated with the players that participated in the game outcome. Alternatively or additionally, the skill score for each player may be stored in a player profile data store, a skill score matrix, and the like.

It is to be appreciated that any suitable data store in any suitable format may be used to store and/or communicate the skill scores and game outcome to the skill scoring system 200, including a relational database, object-oriented database, unstructured database, an in-memory database, or other data store. A storage array may be constructed using a flat file system such as ACSII text, a binary file, data transmitted across a communication network, or any other file system. Notwithstanding these possible implementations of the foregoing data stores, the term data store and storage array as used herein refer to any data that is collected and stored in any manner accessible by a computer.

The Gaussian model of the distribution may allow efficient update equations for the mean $\mu_i$ and the variance $\sigma_i^2$ as the skill scoring system is learning the skill score for each player. After observing the outcome of a game, e.g., indicated by the rank r of the players for that game, the belief distribution or density P(s) in the skill scores s (e.g., skill score $s_i$ for player i and skill score $s_j$ for player j) may be updated using Bayes rule given by:

$$P(s \mid r, \{i_1, \ldots, i_k\}) = \frac{P(r \mid s, \{i_1, \ldots, i_k\})P(s \mid \{i_1, \ldots, i_k\})}{P(r \mid \{i_1, \ldots, i_k\})} = \frac{P(r \mid s_{i_1}, \ldots, s_{i_k})P(s)}{P(r \mid \{i_1, \ldots, i_k\})} \quad (3)$$

where the variable $i_k$ is an identifier or indicator for each player of the team k participating in the game. In the two player example, the vector $i_1$ for the first team is an indicator for player A and the vector $i_2$ for the second team is an indicator for player B. In the multiple player example discussed further below, the vector i may be more than one for each team. In the multiple team example discussed further below, the number of teams k may be greater than two. In a multiple team example of equation (3), the probability of the ranking given the skill scores of the players $P(r|\{s_{i_1}, \ldots, s_{i_k}\})$ be modified given the skill scores of the team $S(s_{ik})$ which is a function of the skill scores of the individual players of the team.

The new updated belief, $P(s|r,\{i_1, \ldots, i_k\})$ is also called the posterior belief (e.g., the updated skill scores 214, 216) and may be used in place of the prior belief P(s), e.g., the player skill scores 212 in the evaluation of the next game for those opponents. Such a methodology is known as on-line learning, e.g., over time only one belief distribution P(s) is maintained and each observed game outcome r for the players participating $\{i_1, \ldots, i_k\}$ is incorporated into the belief distribution.

After incorporation into the determination of the players' skill scores, the outcome of the game may be disregarded. However, the game outcome r may not be fully encapsulated into the determination of each player's skill score. More particularly, the posterior belief $P(s|r,\{i_1, \ldots, i_k\})$ may not be represented in a compact and efficient manner, and may not be computed exactly. In this case, a best approximation of the true posterior may be determined using any suitable approximation technique including expectation propagation, variational inference, assumed density filtering, Laplace approximation, maximum likelihood, and the like. Assumed Density Filtering (ADF) computes the best approximation to the true posterior in some family that enjoys a compact representation—such as a Gaussian distribution with a diagonal covariance. This best approximation may be used as the new prior distribution. The examples below are discussed with reference to assumed density filtering solved either through numerical integration and/or expectation propagation.

Gaussian Distribution

The belief in the skill score of each player may be based on a Gaussian distribution. A Gaussian density having n dimensions is defined by:

$$N(x;\mu,\Sigma) = (2\pi)^{\frac{n}{2}}|\Sigma|^{-\frac{1}{2}}\exp\left(-\frac{1}{2}(x-\mu)^T\Sigma^{-1}(x-\mu)\right) \quad (4)$$

The Gaussian of N(x) may be defined as a shorthand notation for a Gaussian defined by N(x; 0, I), where I is the unit matrix. The cumulative Gaussian distribution function may be indicated by $\Phi(t;\mu,\sigma^2)$ which is defined by:

$$\Phi(t;\mu,\sigma^2) = P_{x\cong N(x;\mu,\sigma^2)}(x \leq t) = \int_{-\infty}^{t} N(x;\mu,\sigma^2)\,dx \quad (5)$$

Again, the shorthand of $\Phi(t)$ indicates a cumulative distribution of $\Phi(t; 0,1)$. The notation of $\langle f(x)\rangle_{x\sim P}$ denotes the expectation of $f$ over the random draw of x, that is $\langle f(x)\rangle_{x\sim P}=\int f(x)dP(x)$. The posterior probability of the outcome given the skill scores or the probability of the skill scores given the outcome may not be a Gaussian. Thus, the posterior may be estimated by finding the best Gaussian such that the Kullback-Leibler divergence between the true posterior and the Gaussian approximation is minimized. For example, the posterior $P(\theta|x)$ may be approximated by $N(\theta, \mu^*_x, \Sigma_x)$ where the superscript * indicates that the approximation is optimal for the given x. In this manner, the mean and variance of the approximated Gaussian posterior may be given by:

$$\mu^*_x=\mu+\Sigma g_x \tag{6}$$

$$\Sigma^*_x=\Sigma-\Sigma(g_x g_x^T-2G_x)\Sigma \tag{7}$$

where the vector $g_x$ and the matrix $G_x$ are given by:

$$g_x = \left.\frac{\partial \log(Z_x(\tilde{\mu}, \tilde{\Sigma}))}{\partial \tilde{\mu}}\right|_{\tilde{\mu}=\mu,\tilde{\Sigma}=\Sigma} \tag{8}$$

$$G_x = \left.\frac{\partial \log(Z_x(\tilde{\mu}, \tilde{\Sigma}))}{\partial \tilde{\Sigma}}\right|_{\tilde{\mu}=\mu,\tilde{\Sigma}=\Sigma} \tag{9}$$

and the function $Z_x$ is defined by:

$$Z_x(\mu,\Sigma)=\int t_x(\theta)N(\theta; \mu, \Sigma)d\theta=P(x) \tag{10}$$

Rectified Truncated Gaussians

A variable x may be distributed according to a rectified double truncated Gaussian (referred to as "rectified Gaussian" from here on) and annotated by $x\sim R(x; \mu, \sigma^2, \alpha, \beta)$ if the density of x is given by:

$$R(x; \mu, \sigma^2, \alpha, \beta) = I_{x\in(\alpha,\beta)}\frac{N(x; \mu, \sigma^2)}{\Phi(\beta; \mu, \sigma^2)-\Phi(\alpha; \mu, \sigma^2)} \tag{11}$$

$$= I_{x\in(\alpha,\beta)}\frac{N\left(\frac{x-\mu}{\sigma}\right)}{\sigma\left(\Phi\left(\frac{\beta-\mu}{\sigma}\right)-\Phi\left(\frac{\alpha-\mu}{\sigma}\right)\right)} \tag{12}$$

When taking the limit of the variable $\beta$ as it approaches infinity, the rectified Gaussian may be denoted as $R(x; \mu, \sigma^2, \alpha)$.

The class of the rectified Gaussian contains the Gaussian family as a limiting case. More particularly, if the limit of the rectified Gaussian is taken as the variable a approaches infinity, then the rectified Gaussian is the Normal Gaussian indicated by $N(x; \mu, \sigma^2)$ used as the prior distribution of the skill scores.

The mean of the rectified Gaussian is given by:

$$\langle x\rangle_{x\sim R} = \mu + \sigma v\left(\frac{\mu}{\sigma}, \frac{\alpha}{\sigma}, \frac{\beta}{\sigma}\right) \tag{13}$$

where the function $v(\bullet, \alpha, \beta)$ is given by:

$$v(t, \alpha, \beta) = \frac{N(\alpha-t)-N(\beta-t)}{\Phi(\beta-1)-\Phi(\alpha-1)} \tag{14}$$

The variance of the rectified Gaussian is given by:

$$\langle x^2\rangle_{x\sim R}-(\langle x\rangle_{x\sim R})^2 = \sigma^2\left(1-w\left(\frac{\mu}{\sigma}, \frac{\alpha}{\sigma}, \frac{\beta}{\sigma}\right)\right) \tag{15}$$

where the function $w(\bullet, \alpha, \beta)$ is given by:

$$w(t, \alpha, \beta) = v^2(t, \alpha, \beta) + \frac{(\beta-t)N(\beta-t)-(\alpha-t)N(\alpha-t)}{\Phi(\beta-1)-\Phi(\alpha-1)} \tag{16}$$

As $\beta$ approaches infinity, the functions $v(\bullet, \alpha, \beta)$ and $w(\bullet, \alpha, \beta)$ may be indicated as $v(\bullet, \alpha)$ and $w(\bullet, \alpha)$ and determined using:

$$v(t, \alpha) = \lim_{\beta\to\infty} v(t, \alpha, \beta) = \frac{N(t-\alpha)}{\Phi(t-\alpha)} \tag{17}$$

$$w(t, \alpha) = \lim_{\beta\to\infty} w(t, \alpha, \beta) = v(t-\alpha)\cdot(v(t, \alpha)-(t-\alpha)) \tag{18}$$

These functions may be determined using numerical integration techniques, or any other suitable technique. The function $w(\bullet, \alpha)$ may be a smooth approximation to the indicator function $I_{t\leq\alpha}$ and may be always bounded by [0,1]. In contrast, the function $v(\bullet, \alpha)$ may grow roughly like $\alpha-t$ for $t<\alpha$ and may quickly approach zero for $t>\alpha$.

The auxiliary functions $\tilde{v}(t,\epsilon)$ and $\tilde{w}(t,\epsilon)$ may be determined using:

$$\tilde{v}(t,\epsilon)=v(t,-\epsilon,\epsilon)$$

$$\tilde{w}(t,\epsilon)=w(t,-\epsilon,\epsilon) \tag{20}$$

Learning Skill Scores Over Time

A Bayesian learning process for a skill scoring system learns the skill scores for each player based upon the outcome of each match played by those players. Bayesian learning may assume that each player's unknown, true skill score is static over time, e.g., that the true player skill scores do not change. Thus, as more games are played by a player, the updated player's skill score 214 of FIG. 2 may reflect a growing certainty in this true skill score. In this manner, each new game played may have less impact or effect on the certainty in the updated player skill score 214.

However, a player may improve (or unfortunately worsen) over time relative to other players and/or a standard scale. In this manner, each player's true skill score is not truly static over time. Thus, the learning process of the skill scoring system may learn not only the true skill score for each player, but may allow for each player's true skill score to change over time due to changed abilities of the player. To account for changed player abilities over time, the posterior belief of the skill scores $P(s|r, \{i_1, \ldots, i_k\})$ may be modified over time. For example, not playing the game for a period of time (e.g., $\Delta t$) may allow a player's skills to atrophy or worsen. Thus, the posterior belief of the skill score of a player may be modified based upon the playing history of that player. More particularly, the posterior belief used as the new prior distribution may be represented as the posterior belief $P(s_i|\Delta t)$ of the skill score of the player with index i, given that he had not played for a time of $\Delta t$. Thus, the modified posterior distribution may be represented as:

$$P(s_i \mid \Delta t) = \int P(s_i \mid \mu)P(\mu \mid \Delta t)d\mu = \int N(s_i; \mu, \sigma^2)N(\mu, \mu_i, \tau^2(\Delta t))d\mu = N(s_i; \mu_i, \sigma_i^2 + \tau^2(\Delta t)) \quad (21)$$

where the first term $P(s_i|\mu)$ is the belief distribution of the skill score of the player with the index i, and the second term $P(\mu|\Delta t)$ quantifies the belief in the change of the unknown true skill score at a time of length $\Delta t$ since the last update. The function $\tau(\bullet)$ is the variance of the true skill score as a function of time not played (e.g., $\Delta t$). The function $\tau(\Delta t)$ may be small for small times of $\Delta t$ to reflect that a player's performance may not change over a small period of non-playing time. This function may increase as $\Delta t$ increases (e.g., hand-eye coordination may atrophy, etc). In the example below, the dynamic skill score function $\tau$ may return a constant value $\tau_0$, if the time passed since the last update is greater than zero as this indicates that at least one more game was played. If the time passed is zero, then the function $\tau$ may return 0. The constant function $\tau_0$ for the dynamic skill score function $\tau$ may be represented as:

$$\tau^2(\Delta t) = I_{\Delta t>0}\tau_0^2 \quad (22)$$

where I is the indicator function.

Inference

The belief in a particular game outcome may be quantified with all knowledge obtained about the skill scores of each player, P(s). More particularly, the outcome of a potential game given the skill scores of selected players may be determined. The belief in an outcome of a game for a selected set of players may be represented as:

$$P(r \mid \{i_1, \ldots, i_k\}) = \int P(r \mid s, \{i_1, \ldots, i_k\})P(s \mid \{i_1, \ldots, i_k\})ds = \int P(r \mid S(s_{i_1}), \ldots, S(s_{i_k}))P(s)ds \quad (23)$$

where $S(s_{i_1}), \ldots, S(s_{i_k})$ is $s_A$ and $s_B$ for a two payer game. Such a belief in a future outcome may be used in matching players for future games, as discussed further below.

Two Player Example

With two players (player A and player B) opposing one another in a game, the outcome of the game can be summarized in one variable y which is 1 if player A wins, 0 if the players tie, and −1 if player A loses. In this manner, the variable y may be used to uniquely represent the ranks r of the players. In light of equation (3) above, the update algorithm may be derived as a model of the game outcome y given the skill scores $s_1$ and $s_2$ as:

$$P(r|s_A,s_B)=P(y(r)|s_A,s_B) \quad (24)$$

where $y(r)=\text{sign}(r_B-r_A)$, where $r_A$ is 1 and $r_B$ is 2 if player A wins, and $r_A$ is 2 and $r_B$ is 1 if player B wins, and $r_A$ and $r_B$ are both 1 if players A and B tie.

Figure 3:
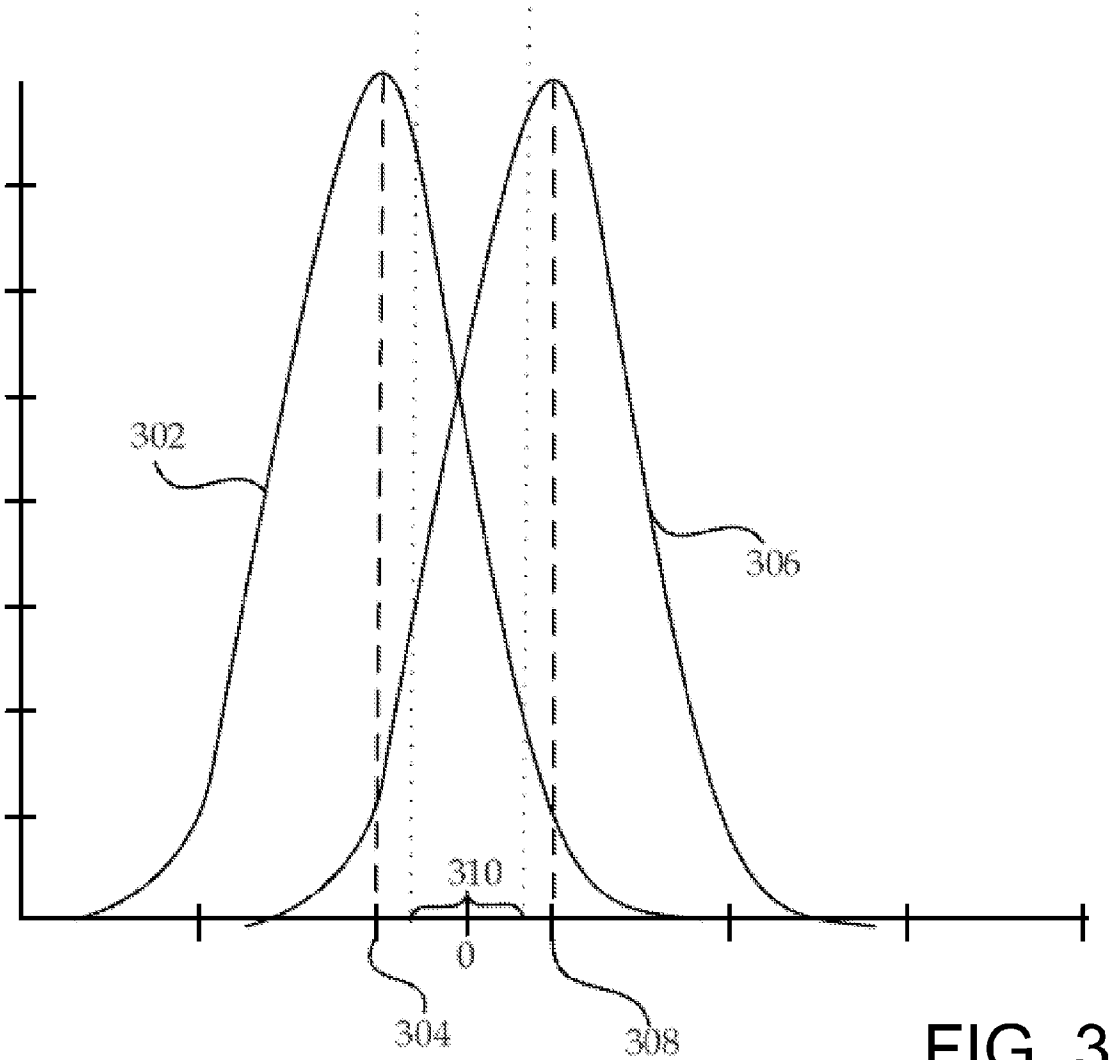
FIG. 3 is an example graph of two latent skill score distributions.

The outcome of the game (e.g., variable y) may be based on the latent skill scores of all participating players (which in the two player example are players A and B). The latent skill score x, may follow a Gaussian distribution with a mean equivalent to the skill score $s_i$ of the player with index i, and a fixed latent skill score variance $\beta^2$. More particularly, the latent skill score $x_i$ may be represented as $N(x_i; s_i, \beta^2)$. Graphical representations of the latent skill scores are shown in FIG. 3 as Gaussian curves 302 and 306 respectively. The skill scores $S_A$ and $s_B$ are illustrated as lines 304 and 308 respectively.

The latent skill scores of the players may be compared to determine the outcome of the game. However, if the difference between the teams is small to zero, then the outcome of the game may be a tie. In this manner, a latent tie margin variable $\epsilon$ may be introduced as a fixed number to illustrate this small margin of equality between two competing players. Thus, the outcome of the game may be represented as:

$$\text{Player } A \text{ is the winner if: } x_A > x_B + \epsilon \quad (25)$$

$$\text{Player } B \text{ is the winner if: } x_B > x_A + \epsilon \quad (26)$$

$$\text{Player } A \text{ and } B \text{ tie if: } |x_A - x_B| \le \epsilon \quad (27)$$

A possible latent tie margin is illustrated in FIG. 3 as the range 310 of width $2\epsilon$ around zero.

Since the two latent skill score curves are independent (due to the independence of the latent skill scores for each player), then the probability of an outcome y given the skill scores of the individual players A and B, may be represented as:

$$P(y \mid s_A, s_B) = \begin{cases} P(\Delta < -\varepsilon) & \text{if } y = -1 \quad (28) \\ P(|\Delta| \le \varepsilon) & \text{if } y = 0 \quad (29) \\ P(\Delta > \varepsilon) & \text{if } y = +1 \quad (30) \end{cases}$$

where $\Delta$ is the difference between the latent skill scores $x_A$ and $x_B$ (e.g., $\Delta = x_A - x_B$).

Figure 4:
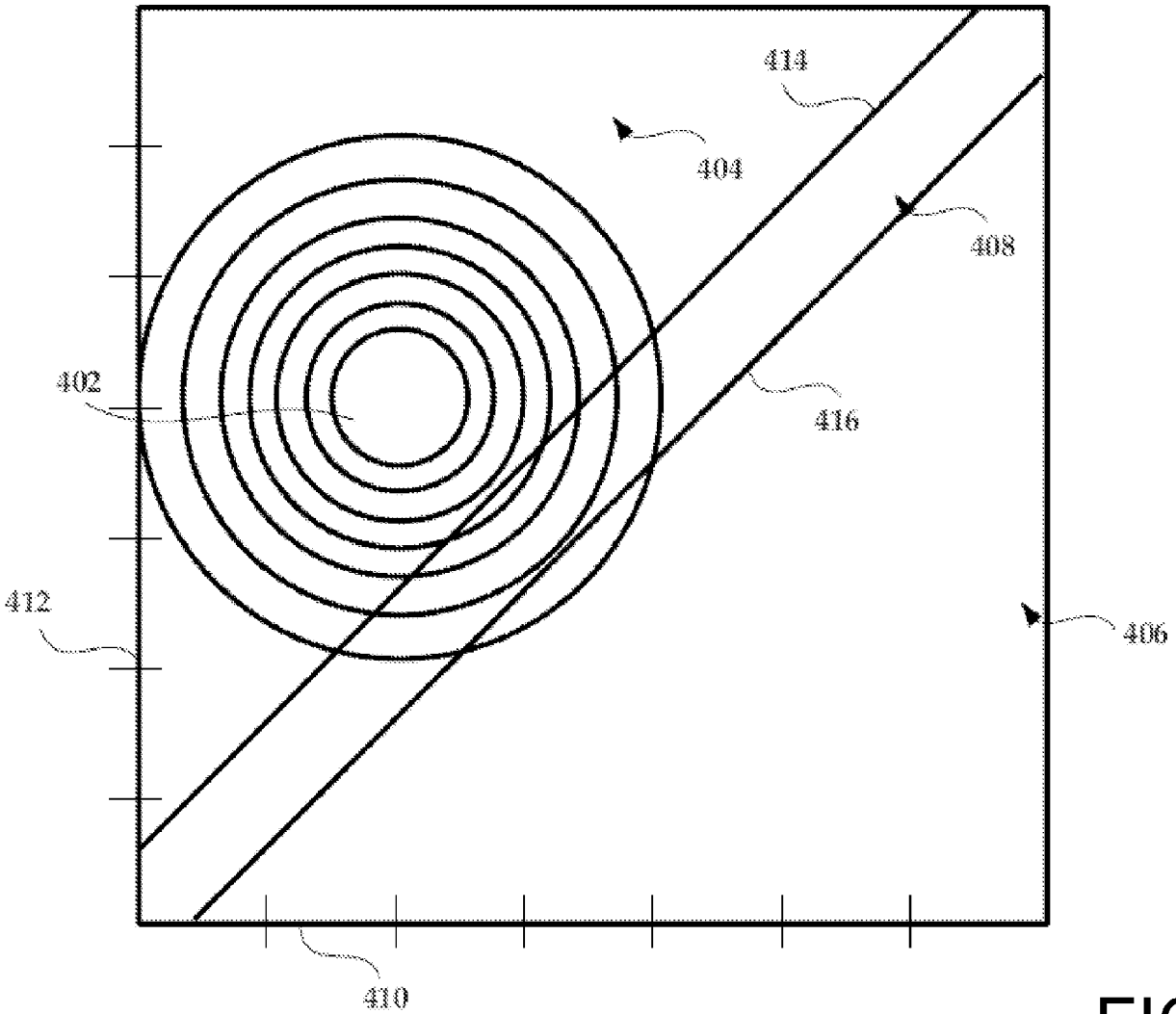
FIG. 4 is an example graph of the joint distribution of the skill scores of two players.

The joint distribution of the latent skill scores for player A and player B are shown in FIG. 4 as contour lines forming a 'bump' 402 in a graph with the first axis 410 indicating the latent skill score of player A and the second axis 412 indicating the latent skill score of player B. The placement of the 'bump' 402 or joint distribution may indicate the likelihood of player A or B winning by examining the probability mass of the area of the region under the 'bump' 402. For example, the probability mass of area 404 above line 414 may indicate that player B is more likely to win, the probability mass of area 406 below line 416 limited by lines 414 and 416 may indicate that player A is more likely to win, and the probability mass of area 408 may indicate that the players are likely to tie. In this manner, the probability mass of area 404 under the joint distribution bump 402 is the probability that player B wins, the probability mass of area 406 under the joint distribution bump 402 is the probability that player A wins, and the probability mass of area 408 under the joint distribution bump 402 is the probability that the players tie. As shown in the example joint distribution 402 of FIG. 4, it is more likely that player B will win.

As noted above, the skill score (e.g., mean $\mu_i$ and variance $\sigma_i^2$) for each player i (e.g., players A and B), may be updated knowing the outcome of the game between those two players (e.g., players A and B). More particularly, using an ADF approximation, the update of the skill scores of the participating players may follow the method 500 shown in FIG. 5. The static variable(s) may be initialized. For example, the latent tie zone $\epsilon$, the dynamic time update constant $\tau_0$, and/or the latent skill score variation $\beta$ may be initialized 502. Example initial values for these parameters may be include: $\beta$ is within the range of approximately 100 to approximately 400 and in one example may be approximately equal to 250, $\tau_0$ is within the range of approximately 1 to approximately 10 and may be approximately equal to 10 in one example, and c may depend on many factors such as the draw probability and in one example may be approximately equal to 50. The skill score $s_i$ (e.g., represented by the mean $\mu_i$ and variance $\sigma_i^2$) may be received 504 for each of the players i, which in the two player example includes mean $\mu_A$ and variance $\sigma_A^2$ for player A and mean $\mu_B$ and variance $\sigma_B^2$ for player B.

Before a player has played a game, the skill score represented by the mean and variance may be initialized to any suitable values. In a simple case, the means may be all initialized at the same value, for example $\mu_i$=1200. The variance may be initialized to indicate uncertainty about the initialized mean, for example, $\sigma^2=400^2$.

Alternatively, the initial mean and/or variance of a player may be based in whole or in part on the skill score of that player in another game environment. In one implementation, initial skill scores for a new game environment may be seeded by one or more skill scores associated with the player in other game environments. The influence that the skill scores for these other game environments may have in the skill score seeding for the new game environment may be weighted based on a defined compatibility factor with the new game environment. For example, the player skill scores in racing game A and racing game B might have a high compatibility to a new racing game Z. Therefore, they may be weighted more heavily in the skill score seeding for new racing game Z than a first player shooter game C. Nevertheless, the first player shooter game C may be weighted more heavily than a simulation game D. The compatibility factor can be determined based on a game-to-game basis, compatible categories or features, game developer defined parameters, or any combination of considerations. More detailed discussions are provided with regard to FIGS. 10-11.

If the belief is to be updated based on time, as described above, the variance of each participating player's skill score may be updated based on the function $\tau$ and the time since the player last played. The dynamic time update may be done in the dynamic skill score module 204 of the skill scoring system of FIG. 2. As noted above, the output of the dynamic skill score function $\tau$ may be a constant $\tau_0$ for all times greater than 0. In this manner, $\tau_0$ may be zero on the first time that a player plays a game, and may be the constant $\tau_0$ thereafter. The variance of each player's skill score may be updated 505 by:

$$\sigma_i^2 \leftarrow \sigma_i^2 + \tau_0^2 \tag{31}$$

To update the skill scores based on the game outcome, a parameter c may be computed 506 as the sum of the variances, such that parameter c is:

$$c = (n_A + n_B)\beta^2 + \sigma_A^2 + \sigma_B^2 \tag{32}$$

$$= 2\beta^2 + \sigma_A^2 + \sigma_B^2 \tag{33}$$

where $n_A$ is the number of players in team A (in this example 1) and $n_B$ is the number of players in team B (in this example 1).

The parameter h may be computed 506 based on the mean of each player's skill score and the computed parameter c as:

$$h_A = \frac{\mu_A - \mu_B}{\sqrt{c}} \tag{34}$$

$$h_B = \frac{\mu_B - \mu_A}{\sqrt{c}} \tag{35}$$

which, indicates that $h_A = -h_B$. The parameter may be computed 506 based on the number of players, the latent tie zone $\epsilon$, and the parameter c as:

$$\varepsilon' = \frac{\varepsilon(n_A + n_B)}{2\sqrt{c}} \tag{36}$$

And for the two player example, this leads to:

$$\varepsilon' = \frac{\varepsilon}{\sqrt{c}} \tag{37}$$

The outcome of the game between players A and B may be received 508. For example, the game outcome may be represented as the variable y which is −1 if player B wins, 0 if the players tie, and +1 if player A wins. To change the belief in the skill scores of the participating players, such as in the skill score update module of FIG. 2, the mean and variance of the each skill score may be updated 510. More particularly, if the player A wins (e.g., y=1), then the mean $\mu_A$ of the winning player A may be updated as:

$$\mu_A \leftarrow \mu_A + \frac{\sigma_A^2}{\sqrt{c}} v(h_A, \varepsilon') \tag{38}$$

The mean $\mu_B$ of the losing player B may be updated as:

$$\mu_B \leftarrow \mu_B - \frac{\sigma_B^2}{\sqrt{c}} v(h_A, \varepsilon') \tag{39}$$

The variance $\sigma_i^2$ of each player i (A and B) may be updated when player A wins as:

$$\sigma_i^2 \leftarrow \sigma_i^2\left(1 - \frac{\sigma_i^2}{c} w(h_A, \varepsilon')\right) \tag{40}$$

However, if player B wins (e.g., y=−1), then the mean $\mu_A$ of the losing player A may be updated as:

$$\mu_A \leftarrow \mu_A - \frac{\sigma_A^2}{\sqrt{c}} v(h_B, \varepsilon') \tag{41}$$

The mean $\mu_B$ of the winning player B may be updated as:

$$\mu_B \leftarrow \mu_B + \frac{\sigma_B^2}{\sqrt{c}} v(h_B, \varepsilon') \tag{42}$$

The variance $\sigma_i^2$ of each player i (A and B) may be updated when player B wins as:

$$\sigma_i^2 \leftarrow \sigma_i^2\left(1 - \frac{\sigma_i^2}{c} w(h_B, \varepsilon')\right) \tag{43}$$

If the players A and B draw, then the mean $\mu_A$ of the player A may be updated as:

$$\mu_A \leftarrow \mu_A + \frac{\sigma_A^2}{\sqrt{c}}\tilde{v}(h_A, \varepsilon') \tag{44}$$

The mean $\mu_B$ of the player B may be updated as:

$$\mu_B \leftarrow \mu_B + \frac{\sigma_B^2}{\sqrt{c}}\tilde{v}(h_B, \varepsilon') \tag{45}$$

The variance $\sigma_A^2$ of player A may be updated when the players tie as:

$$\sigma_A^2 \leftarrow \sigma_A^2\left(1 - \frac{\sigma_A^2}{c}\tilde{w}(h_A, \varepsilon')\right) \tag{46}$$

The variance $\sigma_B^2$ of player B may be updated when the players tie as:

$$\sigma_B^2 \leftarrow \sigma_B^2\left(1 - \frac{\sigma_B^2}{c}\tilde{w}(h_B, \varepsilon')\right) \tag{47}$$

In equations (38-47) above, the functions v(•), w(•), $\tilde{v}$(•), and $\tilde{w}$(•) may be determined from the numerical approximation of a Gaussian. Specifically, functions v(•), w(•), $\tilde{v}$(•), and $\tilde{w}$(•) may be evaluated using equations (17-20) above using numerical methods such as those described in Press et al., Numerical Recipes in C: the Art of Scientific Computing (2d. ed.), Cambridge, Cambridge University Press, ISBN-0-521-43108-5, which is incorporated herein by reference, and by any other suitable numeric or analytic method.

The updated values of the mean and variance of each player's skill score from the skill score update module 202 of FIG. 2 may replace the old values of the mean and variance (skill scores 212). The newly updated mean and variance of each player's skill score incorporate the additional knowledge gained from the outcome of the game between players A and B.

The updated beliefs in a player's skill score may be used to predict the outcome of a game between two potential opponents. For example, a player match module 206 shown in FIG. 2 may use the updated and/or maintained skill scores of the players to predict the outcome of a match between any potential players and match those players meeting match criteria, such as approximately equal player skill score means, player indicated preferences, approximately equal probabilities of winning and/or drawing, and the like.

To predict the outcome of a game, the probability of a particular outcome y given the mean skill scores and standard deviations of the skill scores for each potential player, e.g., $P(y|s_A,s_B)$ may be computed. Accordingly, the probability P(y) of the outcome y may be determined from the probability of the outcome given the player skill scores with the skill scores marginalized out.

Figure 6:
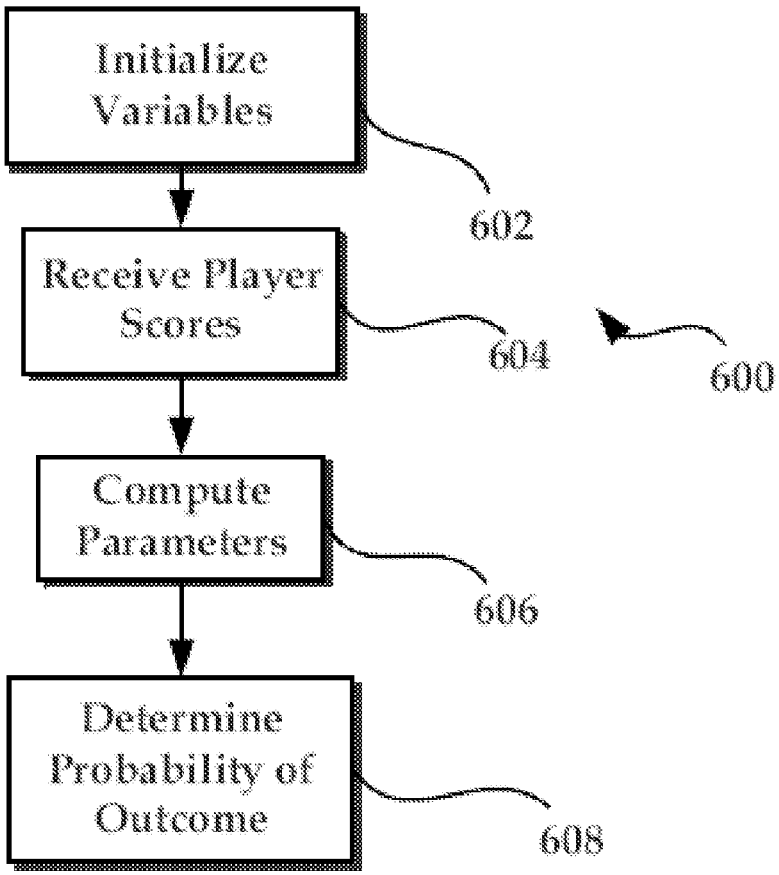
FIG. 6 is a flow chart of an example method of matching two players or teams based on their skill score distributions.

FIG. 6 illustrates an example method 600 of predicting a game outcome between two potential players (player A and player B). The static variable(s) may be initialized 602. For example, the latent tie zone c, the dynamic time update constant $\tau_0$, and/or the latent skill score variation $\beta$ may be initialized. The skill score $s_i$ (e.g., represented by the mean $\mu_i$ and variance $\sigma_i^2$) may be received 604 for each of the players i who are participating in the predicted game. In the two player example, the player skill scores include mean $\mu_A$ and variance $\sigma_A^2$ for player A, and mean $\mu_B$ and variance $\sigma_B^2$ for player B.

Parameters may be determined 606. The parameter c may be computed 606 as the sum of the variances using equation (32) or (33) above as appropriate. Equations (32) and (33) for the parameter c may be modified to include the time varying aspects of the player's skill scores, e.g., some time $\Delta t$ has passed since the last update of the skill scores. The modified parameter c may be computed as:

$$c=(n_A+n_B)\beta^2+\sigma_A^2+\sigma_B^2+(n_A+n_B)\tau_0 \tag{48}$$

where $n_A$ is the number of players in team A (in this example 1 player) and $n_B$ is the number of players in team B (in this example 1 player). The parameter $\epsilon'$ may be computed using equation (36) or (37) above as appropriate.

The probability of each possible outcome of the game between the potential players may be determined 608. The probability of player A winning may be computed using:

$$P(y = 1) = \Phi\left(\frac{\mu_A - \mu_B - \varepsilon'}{\sqrt{c}}\right) \tag{49}$$

The probability of player B winning may be computed using:

$$P(y = -1) = \Phi\left(\frac{\mu_B - \mu_A - \varepsilon'}{\sqrt{c}}\right) \tag{50}$$

As noted above, the function $\Phi$ indicates a cumulative Gaussian distribution function having an argument of the value in the parentheses and a mean of zero and a standard deviation of one. The probability of players A and B having a draw may be computed using:

$$P(y=0)=1-P(y=1)-P(y=-1) \tag{51}$$

The determined probabilities of the outcomes may be used to match potential players for a game, such as comparing the probability of either team winning or drawing with a predetermined or user provided threshold or other preference. A predetermined threshold corresponding to the probability of either team winning or drawing may be any suitable value such as approximately 25%. For example, players may be matched to provide a substantially equal distribution over all possible outcomes, their mean skill scores may be approximately equal (e.g., within the latent tie margin), and the like. Additional matching techniques which are also suitable for the two player example are discussed below with reference to the multi-team example.

Two Teams

The two player technique described above may be expanded such that 'player A' includes one or more players in team A and 'player B' includes one or more players in team B. For example, the players in team A may have any number of players indicated by $n_A$, and team B may have any number of players indicated by $n_B$. A team may be defined as one or more players whose individual performances in the game achieve a single outcome for all the players on the team.

Each player of each team may have an individual skill score $s_i$ represented by a mean $\mu_i$ and a variance $\sigma_i^2$. More particularly, the players of team A may be indicated with the indices $i_A$, and the players of team B may be indicated with the indices $i_B$.

Since there are only two teams, like the two player example above, there may be three possible outcomes to a match, i.e., team A wins, team B wins, and teams A and B tie. Like the latent skill scores of the two player match above, a team latent skill score t(i) of a team with players having indices i is a linear function of the latent skill scores $x_j$ of the individual players of the team. For example, the team latent skill score t(i) may equal $b(i)^T x$ with b(i) being a vector having n elements. Thus, the outcome of the game may be represented as:

$$\text{Team } A \text{ is the winner if: } t(i_A)>t(i_B)+\epsilon \tag{52}$$

$$\text{Team } B \text{ is the winner if: } t(i_B)>t(i_A)+\epsilon \tag{53}$$

$$\text{Team } A \text{ and } B \text{ tie if: } |t(i_A)-t(i_B)|\leq\epsilon| \tag{54}$$

where $\epsilon$ is the latent tie margin discussed above. The probability of the outcome given the skill scores of the teams $s_{i_A}$ and $s_{i_B}$ is shown in equations (28-30) above. However, in the team example, the term $\Delta$ of equations (28-30) above is the difference between the latent skill scores of the teams $t(i_A)$) and $t(i_B)$). More particularly, the term $\Delta$ may be determined as:

$$\Delta=t(i_A)-t(i_B)=(b(i_A)-b(i_B))^T x=a^T x \tag{55}$$

where x is a vector of the latent skill scores of all players and the vector a comprises linear weighting coefficients.

The linear weighting coefficients of the vector a may be derived in exact form making some assumptions. For example, one assumption may include if a player in a team has a positive latent skill score, then the latent team skill score will increase; and similarly, if a player in a team has a negative latent skill score, then the latent team skill score will decrease. This implies that the vector b(i) is positive in all components of i. The negative latent skill score of an individual allows a team latent skill score to decrease to cope with players who do have a negative impact on the outcome of a game. For example, a player may be a so-called 'team killer' More particularly, a weak player may add more of a target to increase the latent team skill score for the other team than he can contribute himself by skill scoring. The fact that most players contribute positively can be taken into account in the prior probabilities of each individual skill score. Another example assumption may be that players who do not participate in a team (are not playing the match and/or are not on a participating team) should not influence the team skill score. Hence, all components of the vector b(i) not in the vector i should be zero (since the vector x as stored or generated may contain the latent skill scores for all players, whether playing or not). In some cases, only the participating players in a game may be included in the vector x, and in this manner, the vector b(i) may be non-zero and positive for all components (in i). An additional assumption may include that if two players have identical latent skill scores, then including each of them into a given team may change the team latent skill score by the same amount. This may imply that the vector b(i) is a positive constant in all components of i. Another assumption may be that if each team doubles in size and the additional players are replications of the original players (e.g., the new players have the same skill scores $s_i$, then the probability of winning or a draw for either team is unaffected. This may imply that the vector b(i) is equal to the inverse average team size in all components of i such that:

$$b(i)=\frac{2}{n_A+n_B}\sum_{j\in i} e_j \tag{56}$$

where the vector e is the unit n-vector with zeros in all components except for component j which is 1, and the terms $n_A$ and $n_B$ are the numbers in teams A and B respectively. With the four assumptions above, the weighting coefficients a are uniquely determined.

If the teams are equal sized, e.g., $n_A+n_B$, then the mean of the latent player skill scores, and hence, the latent player skill scores x, may be translated by an arbitrary amount without a change in the distribution $\Delta$. Thus, the latent player skill scores effectively form an interval scale. However, in some cases, the teams may have uneven numbering, e.g., $n_A$ and $n_B$ are not equal. In this case, the latent player skill scores live on a ratio scale in the sense that replacing two players each of latent skill score x with one player of latent skill score 2x does not change the latent team skill score. In this manner, a player with mean skill score s is twice as good as a player with mean skill score s/2. Thus, the mean skill scores indicate an average performance of the player. On the other hand, the latent skill scores indicate the actual performance in a particular game and exist on an interval scale because in order to determine the probability of winning, drawing, and losing, only the difference of the team latent skill scores is used, e.g., $t(i_A)-t(i_B)$.

The individual skill score $s_i$ represented by the mean $\mu^i$ and variance $\sigma_i^2$ of each player i in a team participating in a game may be updated based upon the outcome of the game between the two teams. The update equations and method of FIG. 5 for the two player example may be modified for a two team example. With reference to the method 500 of FIG. 5, the latent tie zone $\epsilon$, the dynamic time update constant $\tau_0$, and the latent skill score variation $\beta$ may be initialized 502 as noted above. Similarly, the skill score $s_i$ (e.g., represented by the mean $\mu_i$ and variance $\sigma_i^2$) may be received 504 for each of the players i in each of the two teams, which in the two team example includes mean $\mu_{A_i}$ and variance $\sigma_{A_i}^2$ for the players i in team A and mean $\mu_{B_i}$ and variance $\sigma_{B_i}^2$ for the players i in team B.

Since the update to the belief based on time depends only on the variance of that player (and possibly the time since that player last played), the variance of each player may be updated 505 using equation (31) above. As noted above, the update based on time may be accomplished through the dynamic skill score module 204 of FIG. 2.

Figure 5:
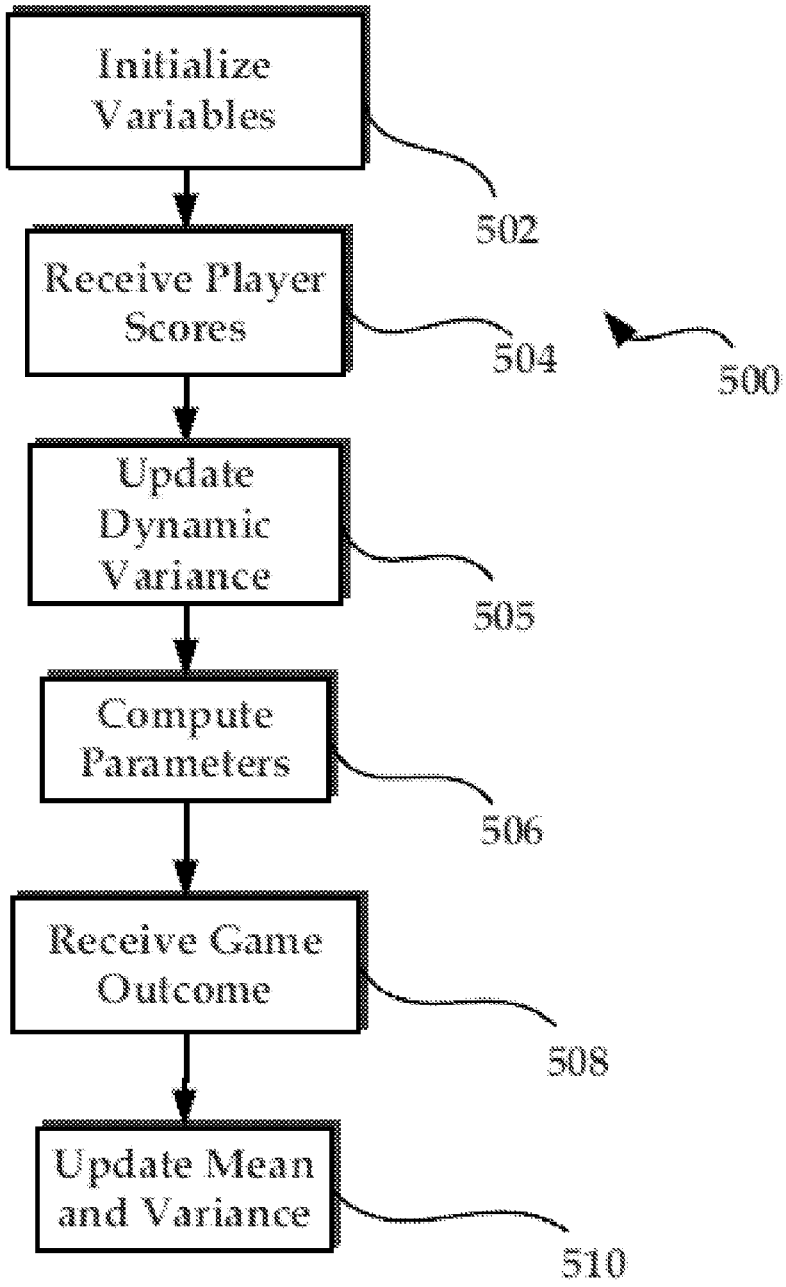
FIG. 5 is a flow chart of an example method of updating skill scores of two players or teams.

With reference to FIG. 5, the parameters may be computed 506 similar to those described above with some modification to incorporate the team aspect of the skill scores and outcome. The parameter c may be computed 506 as the sum of the variances, as noted above. However, in a two team example where each team may have one or more players, the variances of all players participating in the game must be summed. Thus, for the two team example, equation (32) above may be modified to:

$$c=(n_A+n_B)\beta^2+\sum_{i=1}^{n_A}\sigma_{A_i}^2+\sum_{i=1}^{n_B}\sigma_{B_i}^2 \tag{57}$$

The parameters $h_A$ and $h_B$ may be computed 506 as noted above in equations (34-35) based on the mean of each team's skill score $\mu_A$ and $\mu_B$. The team mean skill scores $\mu_A$ and $\mu_B$ for teams A and team B respectively may be computed as the sum of the means of the player(s) for each team as:

$$\mu_A = \sum_{i=1}^{n_A} \mu_{A_i} \tag{58}$$

$$\mu_B = \sum_{i=1}^{n_B} \mu_{B_i} \tag{59}$$

The parameter $\epsilon'$ may be computed 506 as $$\varepsilon' = \frac{\varepsilon(n_A + n_B)}{2\sqrt{c}}$$

where $n_A$ is the number of players in team A, $n_B$ is the number of players in team B.

The outcome of the game between team A and team B may be received 508. For example, the game outcome may be represented as the variable y which is equal to −1 if team B wins, 0 if the teams tie, and +1 if team A wins. To change the belief in the probability of the previous skill scores of each participating player of each team, the mean and variance of each participating player may be updated 510 by modifying equations (38-46) above. If team A wins the game, then the individual means may be updated as:

$$\mu_{A_i} \leftarrow \mu_{A_i} + \frac{\sigma_{A_i}^2}{\sqrt{c}} v(h_A, \varepsilon') \tag{60}$$

$$\mu_{B_i} \leftarrow \mu_{B_i} - \frac{\sigma_{B_i}^2}{\sqrt{c}} v(h_A, \varepsilon') \tag{61}$$

The variance $\sigma_i^2$ of each player i (of either team A or B) may be updated when team A wins as shown in equation (40) above.

However, if team B wins (e.g., y=−1), then the mean $\mu_{A_i}$ of each participating player may be updated as:

$$\mu_{A_i} \leftarrow \mu_{A_i} - \frac{\sigma_{A_i}^2}{\sqrt{c}} v(h_B, \varepsilon') \tag{62}$$

$$\mu_{B_i} \leftarrow \mu_{B_i} + \frac{\sigma_{B_i}^2}{\sqrt{c}} v(h_B, \varepsilon') \tag{63}$$

The variance $\sigma_i^2$ of each player i (of either team A or B) may be updated when team B wins as shown in equation (43) above.

If the teams A and B draw, then the mean $\mu_{A_i}$ and $\mu_{B_i}$ of each player of the teams A and B respectively may be updated as:

$$\mu_{A_i} \leftarrow \mu_{A_i} + \frac{\sigma_{A_i}^2}{\sqrt{c}} \tilde{v}(h_A, \varepsilon') \tag{64}$$

$$\mu_{B_i} \leftarrow \mu_{B_i} + \frac{\sigma_{B_i}^2}{\sqrt{c}} \tilde{v}(h_B, \varepsilon') \tag{65}$$

The variance $\sigma_{A_i}^2$ of each player in team A may be updated when the teams tie as:

$$\sigma_{A_i}^2 \leftarrow \sigma_{A_i}^2 \left(1 - \frac{\sigma_{A_i}^2}{c} \tilde{w}(h_A, \varepsilon')\right) \tag{66}$$

The variance $\sigma_{B_i}^2$ of each player in team B may be updated when the teams tie as:

$$\sigma_{B_i}^2 \leftarrow \sigma_{B_i}^2 \left(1 - \frac{\sigma_{B_i}^2}{c} \tilde{w}(h_B, \varepsilon')\right) \tag{67}$$

As with equations (38-43), the functions v(•), w(•), $\tilde{v}$(•), and $\tilde{w}$(•) may be evaluated using equations (17-20) above using numerical methods. In this manner, the updated values of the mean and variance of each player's skill score may replace the old values of the mean and variance to incorporate the additional knowledge gained from the outcome of the game between teams A and B.

Like the skill scoring update equations above, the matching method of FIG. 6 may be modified to accommodate two teams of one or more players each. Like above, the static variables may be initialized 602. The skill score $s_i$ (represented by the mean $\mu_{A_i}$ and $\mu_{B_i}$ and the variance $\sigma_{A_i}^2$ and $\sigma_{B_i}^2$ each player i of each respective team A and B) may be received 604 for each of the players. In addition, the matchmaking criteria may take into account the variability of skill scores within the team. For example, it may be desirable to have teams comprising players having homogeneous skill scores, because in some cases they may better collaborate.

The parameters may be determined 606 as noted above. For example, the parameter c may be computed using equation (57), the mean of each team $\mu_A$ and $\mu_B$ may be computed using equations (58) and (59), and $\epsilon'$ may be computed using equation (36).

The probability of each possible outcome of the game between the two potential teams may be determined 608. The probability of team A winning may be computed using equation (49) above. The probability of team B winning may be computed using equation (50) above. The probability of a draw may be computed using equation (51) above. The determined probabilities of the outcomes may be used to match potential teams for a game, such as comparing the probability of either team winning and/or drawing, the team and/or player ranks, and/or the team and/or player skill scores with a predetermined or user provided threshold.

Multiple Teams

The above techniques may be further expanded to consider a game that includes multiple teams, e.g., two or more opposing teams which may be indicated by the parameter j. The index j indicates the team within the multiple opposing teams and ranges from 1 to k teams, where k indicates the total number of opposing teams. Each team may have one or more players i, and the jth team may have a number of players indicated by the parameter $n_j$ and players indicated by $i_j$. Knowing the ranking r of all k teams allows the teams to be re-arranged such that the ranks $r_j$ of each team may be placed in rank order. For example, the rank of each team may be placed in rank-decreasing order such that $r_{(1)} \leq r_{(2)} \leq \ldots \leq r_{(k)}$ where the index operator ( ) is a permutation of the indices j from 1 to k. Since in some cases, the rank of 1 is assumed to indicate the winner of the game, the rank-decreasing order may represent a numerically increasing order. In this manner, the outcome r of the game may be represented in terms of the permutation of team indices and a vector $y \in \{0,+1\}^{k-1}$. For example, ($y_j$=+1) if team (j) was winning against team (j+1), and ($y_j$=0) if team (j) was drawing against team (j+1). In this manner, the elements of the vector y may be indicated as $y_j=\text{sign}(r_{(j+1)}-r_{(j)})$.

Like the example above with the two teams, the outcome of the game may be based upon the latent skill scores of all participating players. The latent skill score $x_i$ may follow a Gaussian distribution with a mean equivalent to the skill score $s_i$ of the player with index i, and a fixed latent skill score variance $\beta^2$. In this manner, the latent skill score $x_i$ may be represented by $N(x_i; S_i, \beta^2)$. The latent skill score t(i) of a team with players having indices in the vector i may be a linear function of the latent skill scores x of the individual players. In this manner, the latent skill scores may be determined as $t(i)=b(i)^T x$ with b(i) as described above with respect to the two team example. In this manner, given a sample x of the latent skill scores, the ranking is such that the team with the highest latent team skill score t(i) is at the first rank, the team with the second highest team skill score is at the second rank, and the team with the smallest latent team skill score is at the lowest rank. Moreover, two teams will draw if their latent team skill scores do not differ by more than the latent tie margin $\epsilon$. In this manner, the ranked teams may be re-ordered according to their value of the latent team skill scores. After re-ordering the teams based on latent team skill scores, the pairwise difference between teams may be considered to determine if the team with the higher latent team skill score is winning or if the outcome is a draw (e.g., the skill scores differ by less than $\epsilon$).

To determine the re-ordering of the teams based on the latent skill scores, a k−1 dimensional vector Δ of auxiliary variables may be defined where:

$$\Delta_j := t(i_{(j)}) - -t(i_{(j+1)}) = a_j^T x \tag{68}$$

In this manner, the vector Δ may be defined as:

$$\Delta = A^T x = \begin{bmatrix} a_1^T \\ \dots \\ a_{k+1}^T \end{bmatrix} x \tag{69}$$

Since x follows a Gaussian distribution (e.g., $x \sim N(x; s, \beta^2 I)$, the vector Δ is governed by a Gaussian distribution (e.g., $\Delta \sim N(\Delta; A^T s, \beta^2 A^T A)$. In this manner, the probability of the ranking r (encoded by the matrix A based on the permutation operator ( ) and the k−1 dimensional vector y) can be expressed by the joint probability over Δ as:

$$P(y \mid s_{i_1}, \dots, s_{i_k}) = \prod_{j=1}^{k} (P(\Delta_j > \varepsilon))^{y_j} (P(|\Delta_j| \le \varepsilon))^{1-y_j} \tag{70}$$

The belief in the skill score of each player ($P(s_i)$) which is parameterized by the mean skill scores μ n and variances $\sigma^2$ may be updated given the outcome of the game in the form of a ranking r. The belief may be determined using assumed density filtering with standard numerical integration methods (for example, Gentz, et al., Numerical Computation of Multivariate Normal Probabilities, Journal of Computational and Graphical Statistics 1, 1992, pp. 141-149.), the expectation propagation technique (see below), and any other suitable technique. In the special case that there are two teams (e.g., k=2), the update equations reduce to the algorithms described above in the two team example. And similarly, if each of the two teams has only one player, the multiple team equations reduce to the algorithms described above in the two player example.

In this example, the update algorithms for the skill scores of players of a multiple team game may be determined with a numerical integration for Gaussian integrals. Similarly, the dynamic update of the skill scores based on time since the last play time of a player may be a constant $\tau_0$ for non-play times greater than 0, and 0 for a time delay between games of 0 or at the first time that a player plays the game.

Figure 7:
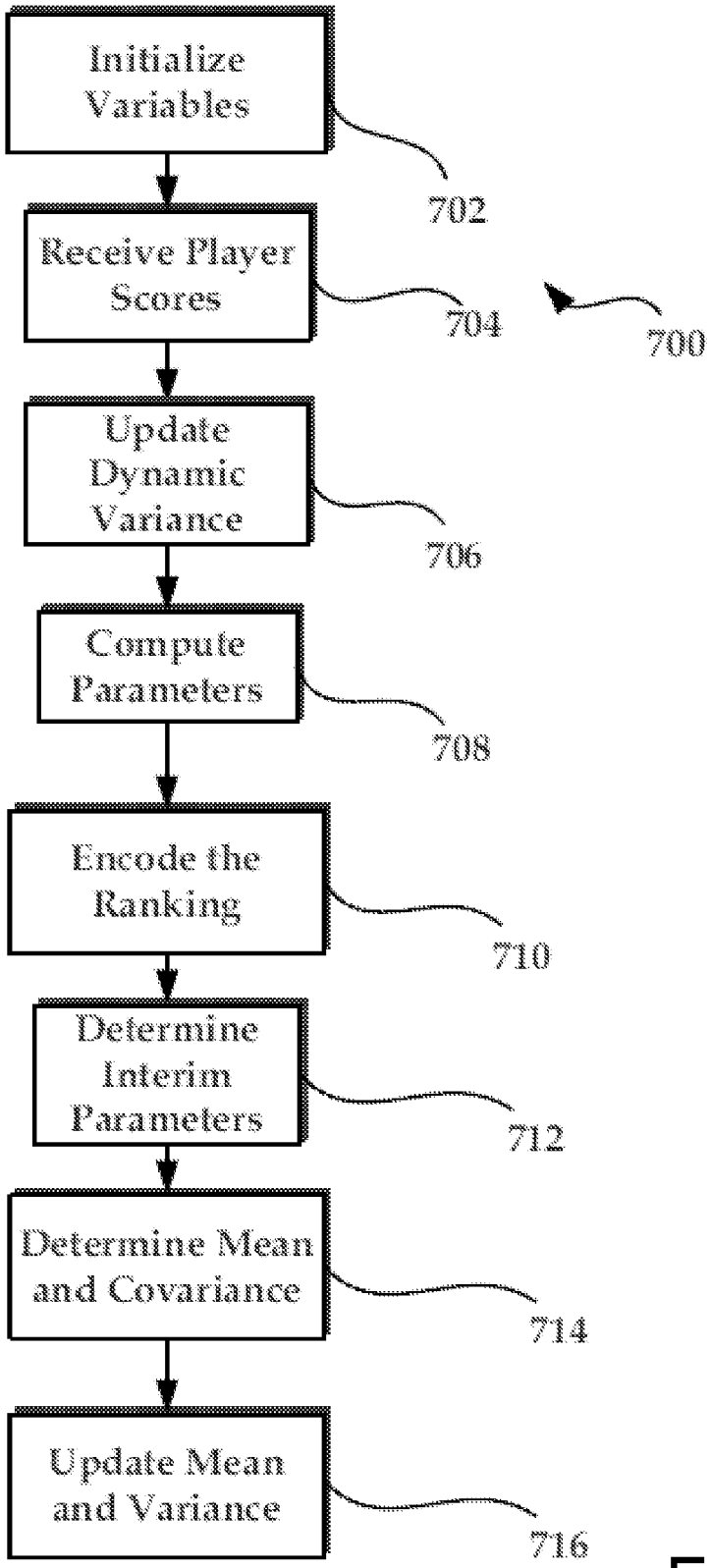
FIG. 7 is a flow chart of an example method of updating skill scores of multiple teams.

FIG. 7 illustrates an example method 700 of updating the skill scores of players playing a multiple team game. The latent tie zone $\epsilon$, the dynamic time update constant $\tau_0$, and the latent skill score variation β may be initialized 702 as noted above. In addition, the matrix A having k−1 columns and n rows (i.e., the total number of players in all teams) may be initialized 702 with any suitable set of numbers, such as 0. The skill score $s_i$ (e.g., represented by the mean $\mu_i$ and variance $\sigma_i^2$) may be received 704 for each of the players i in each of the teams, which in the multiple team example includes mean $\mu_{j_i}$ and variance $\sigma_{j_i}^2$ for the players i in each team j.

Since the update to the belief based on time depends only on the variance of that player (and possibly the time since that player last played), the variance of each player may be updated 706 using equation (31) above. In this manner, for each player in each team, the dynamic update to the variance may be determined before the game outcome is evaluated. More particularly, the update to the variance based on time since the player last played the game, and the player's skill may have changed in that period of time before the current game outcome is evaluation. Alternatively, the belief based on time may be done after the skill scores are updated based on the game outcome.

The skill scores may be rank ordered by computing 708 the permutation ( ) according to the ranks r of the players participating in the game. For example, the ranks may be placed in decreasing rank order.

The ranking r may be encoded 710 by the matrix A. More particularly, for each combination of the $n_{(j)}$ and $n_{(j+1)}$ players of team (j) and (j+1), the matrix element $A_{row,j}$ may be determined as:

$$A_{row,j} = \frac{2}{n_j + n_{(j+1)}} \tag{71}$$

where the row variable is defined by the player $i_j$, the column variable is defined by the index j which varies from 1 to k−1 (where k is the number of teams), and $$A_{row+1,j} = \frac{-2}{n_j + n_{(j+1)}} \tag{72}$$

where the row variable is defined by the player $i_{(j+1)}$, the column variable is defined by the index j which varies from 1 to k−1 (where k is the number of teams), $n_j$ is the number of players on the jth team, and $n_{(j+1)}$ is the number of players on the (j+1)th team. If the jth team is of the same rank as the (j+1) team, then the lower and upper limits a and b of a truncated Gaussian may be set as:

$$a_i = -\epsilon \tag{73}$$

$$b_i = \epsilon \tag{74}$$

Otherwise, if the jth team is not of the same rank as the (j+1) team, then the lower and upper limits a and b of a truncated Gaussian may be set as:

$$a_i=\epsilon \tag{75}$$

$$b_i=\infty \tag{76}$$

The determined matrix A may be used to determine 712 interim parameters. Interim parameters may include a vector u and matrix C using the equations:

$$u=A^T\mu \tag{77}$$

$$C=A^T(\beta^2 I+\mathrm{diag}(\sigma^2))A \tag{78}$$

where the vector $\mu$ is a vector containing the means of the layers, $\beta$ is the latent skill score variation, and $\sigma^2$ is a vector containing the variances of the players. The vector $\mu$ and $\sigma^2$ may contain the means of the participating players or of all the players. If the vector contains the skill score parameters for all the players, then, the construction of A may provide a coefficient of zero for each non-participating player.

The interim parameters u and C may be used to determine 714 the mean z and the covariance Z of a truncated Gaussian representing the posterior with parameters u, C, and integration limits of the vectors a and b. The mean and covariance of a truncated Gaussian may be determined using any suitable method including numerical approximation (see Gentz, et al., Numerical Computation of Multivariate Normal Probabilities, Journal of Computational and Graphical Statistics 1, 1992, pp. 141-149.), expectation propagation (see below), and the like. Expectation Propagation will be discussed further below with respect to FIG. 9.

Using the computed mean z and covariance Z, the skill score defined by the mean $\mu_i$ and the variance $\sigma_i^2$ of each player participating in the multi-team game may be updated 716. In one example, the function vector v and matrix W may be determined using:

$$v=AC^{-1}(z-u) \tag{79}$$

$$W=AC^{-1}(C-Z)C^{-1}A^T \tag{80}$$

Using the vector v and the matrix W, the mean $\mu_{j_i}$ and variance $\sigma_{j_i}{}^2$ of each player i in each team j may be updated using:

$$\mu_{j_i}\leftarrow\mu_{j_i}+\sigma_{j_i}{}^2 v_{j_i} \tag{81}$$

$$\sigma_{j_i}{}^2\leftarrow\sigma_{j_i}{}^2(1-\sigma_{j_i}{}^2 W_{j_i j_i}) \tag{82}$$

The above equations and methods for a multiple team game may be reduced to the two team and the two player examples given above.

In this manner, the update to the mean of each player's skill score may be a linear increase or decrease based on the outcome of the game. For example, if in a two player example, player A has a mean greater than the mean of player B, then player A should be penalized and similarly, player B should be rewarded. The update to the variance of each player's skill score is multiplicative. For example, if the outcome is unexpected, e.g., player A's mean is greater than player B's mean and player A loses the game, then the variance of each player may be reduced more because the game outcome is very informative with respect to the current belief about the skill scores. Similarly, if the players' means are approximately equal (e.g., their difference is within the latent tie margin) and the game results in a draw, then the variance may be little changed by the update since the outcome was to be expected.

As discussed above, the skill scores represented by the mean $\mu$ and variance $\sigma^2$ for each player may be used to predict the probability of a particular game outcome y given the mean skill scores and standard deviations of the skill scores for all participating players. The predicted game outcome may be used to match players for future games, such as by comparing the predicted probability of the outcome of the potential game with a predetermined threshold, player indicated preferences, ensuring an approximately equal distribution over possible outcomes (e.g., within 1-25%), and the like. The approximately equal distribution over the possible outcomes may depend on the number of teams playing the game. For example, with two teams, the match may be set if each team has an approximately 50% chance of winning or drawing. If the game has 3 teams, then the match may be made if each opposing team has an approximately 30% chance of winning or drawing. It is to be appreciated that the approximately equal distribution may be determined from the inverse of number of teams playing the game.

In one example, one or more players matched by the player match module may be given an opportunity to accept or reject a match. The player's decision may be based on given information such as the challenger's skill score and/or the determined probability of the possible outcomes. In another example, a player may be directly challenged by another player. The challenged player may accept or deny the challenge match based on information provided by the player match module.

The probability of a game outcome may be determined from the probability of the outcome given the skill scores $P(y|s_{i_1}, \ldots, s_{i_k})$, where the attained knowledge over the skill scores $s_{i_1}, \ldots, s_{i_k}$ represented by the mean and variance of each player is marginalized out.

Figure 8:
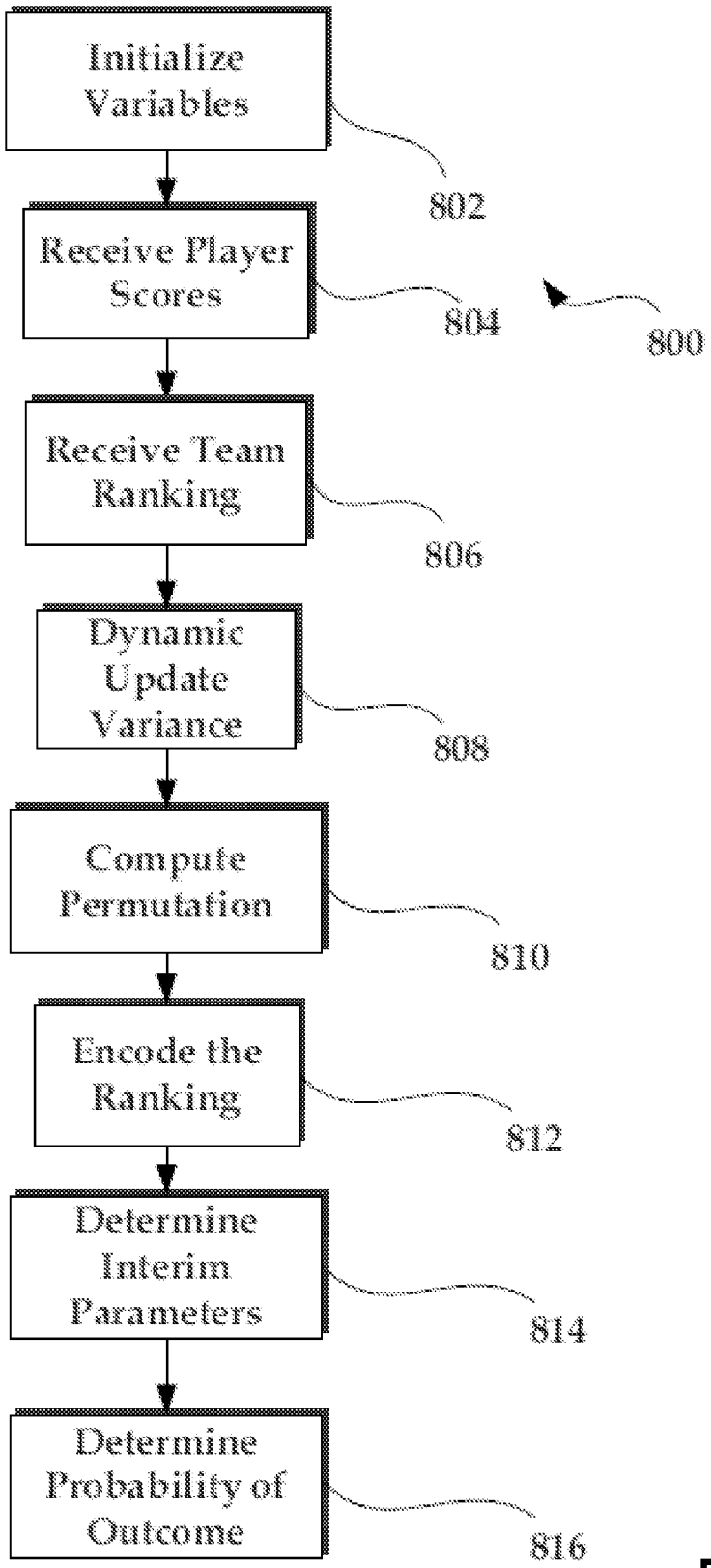
FIG. 8 is a flow chart of an example method of matching skill scores of multiple teams.

Like the skill scoring update equations above, the matching method of FIG. 6 may be modified to accommodate multiple teams of one or more players each. An example modified method 800 of determining the probability of an outcome is shown in FIG. 8. Like above, the static variables, such as the latent skill score variation $\beta$, the latent tie zone $\epsilon$, the constant dynamic $\tau_0$, and the matrix A, may be initialized 802. The matrix A may be initialized to a matrix containing all zeros.

The skill score $s_i$ (represented by the mean $\mu_i$ and the variance $\sigma_i^2$ for each participating player i) may be received 804 for each of the players. The ranking r of the k teams may be received 806. For each player participating, the variance $\sigma_i^2$ may be updated 808 for each participating player based upon the time since that player has last played the game, e.g., dynamic update based on time. In this manner, the variance for each potential participating player i, the variance may be updated using equation (31) above.

The skill scores of the teams may be rank ordered by computing 810 the permutation ( ) according to the ranks r of the players. For example, as noted above, the ranks may be placed in decreasing rank order.

The encoding of the ranking may be determined 812. The encoding of the ranking may be determined using the method described with reference to determining the encoding of a ranking 710 of FIG. 7 and using equations (71-76). Interim parameters u and C may be determined 814 using equations (77-78) above and described with reference to determining interim parameters 712 of FIG. 7.

The probability of the game outcome may be determined 816 by evaluation of the value of the constant function of a truncated Gaussian with mean u and variance C. As noted above, the truncated Gaussian may be evaluated in any suitable manner, including numerical approximation (see Gentz, et al., Numerical Computation of Multivariate Normal Probabilities, Journal of Computational and Graphical Statistics 1, 1992, pp. 141-149.), expectation propagation, and the like.

Numerical Approximation

One suitable technique of numerical approximation is discussed in Gentz, et al., Numerical Computation of Multivariate Normal Probabilities, Journal of Computational and Graphical Statistics 1, 1992, pp. 141-149. In one example, if the dimensionality (e.g., the number of players $n_j$ in a team j) of the truncated Gaussian is small, then the approximated posterior may be estimated based on uniform random deviates, based on a transformation of random variables which can be done iteratively using the cumulative Gaussian distribution Φ discussed above.

Since the normalization constant $Z_r(u,C)$ equals the probability of the ranking r, then the normalization constant may be determined by integrating the equation:

$$z_r(\mu,\sigma)=\int_a^b N(z;u,C)dz \tag{83}$$

The mean z may be determined using ADF by:

$$\langle z\rangle_{z\sim R(z)} = u(\mu) + \sqrt{C}\left[v\left(\frac{u(\mu)}{\sqrt{C}}\frac{\varepsilon}{\sqrt{C}}\right)\cdot\hat{v}\left(\frac{u(\mu)}{\sqrt{C}}\frac{\varepsilon}{\sqrt{C}}\right)^{1-y}\right] \tag{84}$$

Numerically approximating the above equations will provide the mean and normalization constant which may be used to numerically approximate a truncated Gaussian.

Expectation Propagation

Rather than numerical approximation, expectation propagation may be used to update and/or predict the skill score of a player. In the case of multiple teams, the update and prediction methods may be based on an iteration scheme of the two team update and prediction methods. To reduce the number of inversion s calculated during the expectation propagation, the Gaussian distribution may be assumed to be rank 1 Gaussian, e.g., that the likelihood is some function of the one-dimensional projection of the skill scores s. The efficiency over the general expectation approximation may be increased by assuming that the posterior is a rectified, truncated Gaussian distribution.

Figure 9:
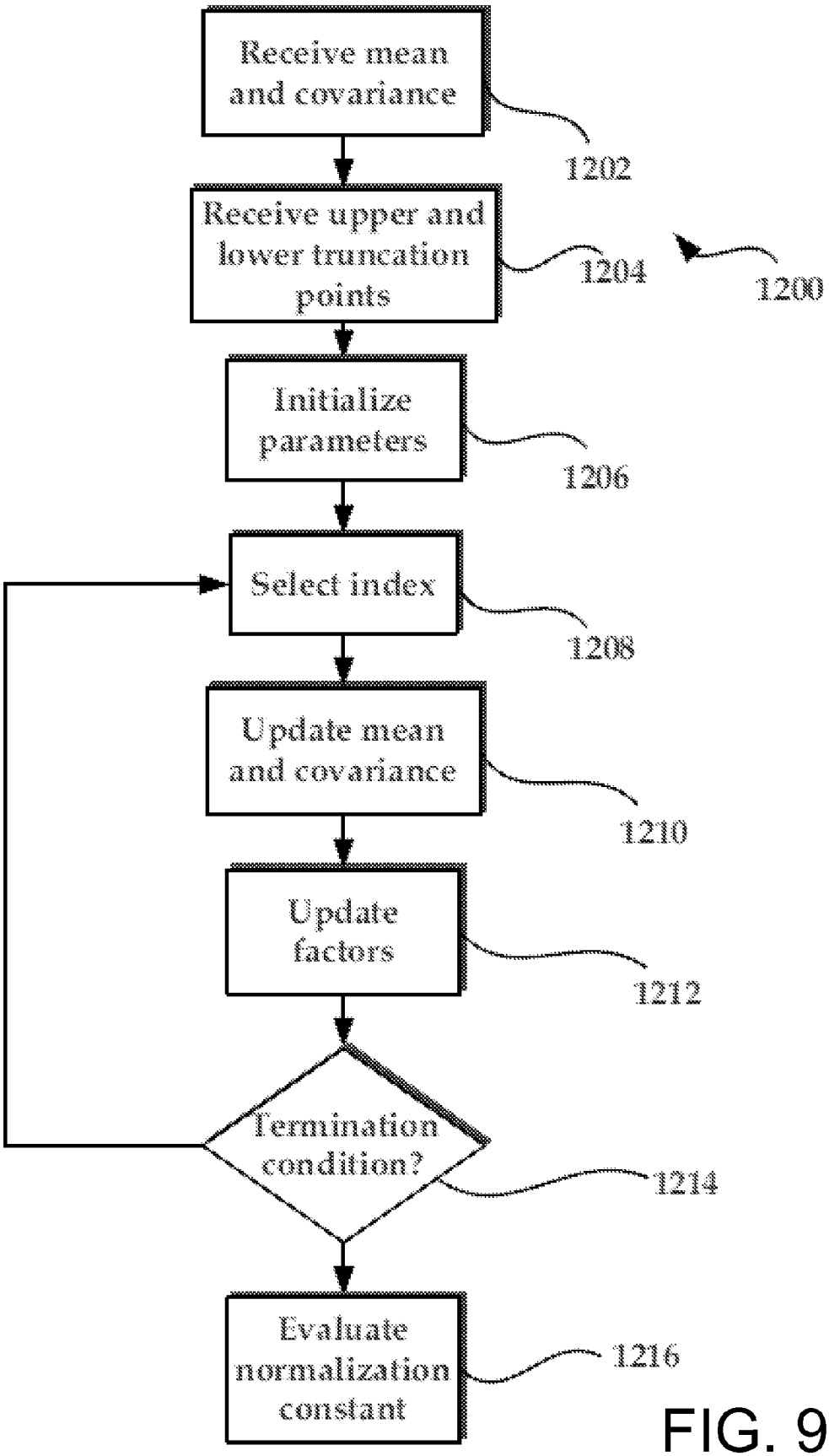
FIG. 9 is a flow chart of an example method of approximating a truncated Gaussian distribution using expectation maximization

For example, FIG. 9 shows an example method 1200 of approximating a truncated Gaussian with expectation propagation.

The mean μ and covariance Σ of a non-truncated Gaussian may be received 1202. The mean may have n elements, and the covariance matrix may be dimensioned as n×n. The upper and lower truncation points of the truncated Gaussian may be received. For example, if the jth team is of the same rank as the j+1 team, then the lower and upper limits a and b of a truncated Gaussian may be set for each j and j+1 player as:

$$a_i=-\epsilon \tag{85}$$

$$b_i=\epsilon \tag{86}$$

Otherwise, if the jth team is not of the same rank as the j+1 team, then the variables a and b may be set for each j and j+1 player as:

$$a_i=\epsilon$$

$$b_i=\infty \tag{87}$$

The parameters of the expectation propagation may be initialized 1206. more particularly, for each i from 1 to n, the mean $\mu_i$ may be initialized to zero or any other suitable value, the parameter $\pi_i$ may be initialized to zero or any other suitable value, the parameter $\zeta_i$ may be initialized to 1 or any other suitable value. The approximated mean μ* may be initialized to the received mean μ, and the approximated covariance Σ* may be initialized to the received covariance Σ.

An index j may be selected 1208 from 1 to n. The approximate mean and covariance (μ* and Σ*) may be updated 1210. More particularly, the approximate mean and covariance may be updated by:

$$\mu^* = \mu^* + \frac{\pi_j(\mu_j^* - \mu_j) + \alpha_j}{e_j}t_j \tag{88}$$

$$\Sigma^* = \Sigma^* + \frac{\pi_j e_j - \beta_j}{e_j^2}t_j t_j^T \tag{89}$$

where $t_j$ is determined by:

$$t_j=[\Sigma_{1,j}^*, \Sigma_{2,j}^*, \ldots, \Sigma_{n,j}^*] \tag{90}$$

and the factors $d_j$ and $e_j$ are determined by:

$$d_j=\pi_j\Sigma_{j,j}^* \tag{91}$$

$$e_j=1-d_j \tag{92}$$

The factors $\alpha_j$ and $\beta_j$ may be determined by:

$$\alpha_j = \frac{v(\varphi_j', a_j', b_j')}{\sqrt{\psi_j}} \tag{93}$$

$$\beta_j = \frac{w(\varphi_j', a_j', b_j')}{\psi} \tag{94}$$

where the function v( ) and w( ) may be evaluated using equations (17-18) above and the parameters $\phi'_j$, $a'_j$, $b'_j$, and $\psi_j$ may be evaluated using:

$$\varphi_j = \mu_j^* + \frac{d_j(\mu_j^* - \mu_j)}{e_j} \tag{95}$$

$$\psi_j = \frac{\Sigma_{j,j}^*}{e_j} \tag{96}$$

$$\varphi_j' = \frac{\varphi_j}{\sqrt{\psi_j}} \tag{97}$$

$$\psi_j' = \frac{\psi_j}{\sqrt{\psi_j}} \tag{98}$$

$$a_j' = \frac{a_j}{\sqrt{\psi_j}} \tag{99}$$

$$b_j' = \frac{b_j}{\sqrt{\psi}} \tag{100}$$

The factors $\pi_j$, $\mu_j$, and $\zeta_j$ may be updated 1212. More particularly, the factors may be updated using:

$$\pi_j = \frac{1}{(\beta_j^{-1} - \psi_j)} \tag{101}$$

$$\mu_j = \varphi_j + \frac{\alpha_j}{\beta_j} \tag{102}$$

-continued $$c_j = (\Phi(b'_j - \varphi'_j) - \Phi(a'_j - \varphi'_j))\exp\frac{\alpha_j^2}{2\beta_j\sqrt{1-\psi_j\beta_j}} \tag{103}$$

The termination criterion may then be evaluated 1214. For example, the termination condition $\Delta_z$ may be computed using:

$$\Delta_z = |Z^* - Z^*_{old}| \tag{104}$$

or any other suitable termination condition which may indicate convergence of the approximation. The determined termination condition $\Delta_z$ may be compared to a predetermined termination toleration criterion $\delta$. If the absolute value of the determined termination condition is less than or equal to the termination toleration criterion, then the approximated mean $\mu^*$, variance $\Sigma^*$, and normalization constant $Z^*$ may be considered converged. If the termination criterion is not fulfilled, then the method may return to selecting an index 1208. If the termination criterion is fulfilled, then the approximated mean and covariance may be returned. In addition, the normalization constant $Z^*$ may be evaluated 1216. More particularly, the normalization constant may be evaluated using:

$$Z^* = \left(\prod_{i=1}^{n} \varsigma_i\right) \cdot \sqrt{|\Sigma^*\Sigma^{-1}|} \cdot \exp\left(-\frac{1}{2}\left(\sum_{i=1}^{n} \pi_i\mu_i^2 + \mu^T\Sigma^{-1}\mu - \mu^{*T}\Sigma^{*-1}\mu^*\right)\right) \tag{105}$$

Matchmaking and Leaderboards

As noted above, the probability of the outcome may be used to match players such that the outcome is likely to be challenging to the teams, in accordance with a predetermined threshold. Determining the predicted outcome of a game may be expensive in some cases in terms of memory to store the entire outcome distribution for more than four teams. More particularly, there are $O(2^{k-1}k!)$ outcomes where k is the number of teams and where O( ) means 'order of', e.g., the function represented by O( ) can only be different by a scaling factor and/or a constant. In addition, the predicted outcomes may not distinguish between players with different standard deviations $\sigma_i$ if their means $\mu_i$ are identical. In some cases, it may be computationally expensive to compute the distance between two outcome distributions. Thus, in some cases it may be useful to compute the skill score gap between the skill scores of two players. For example, the skill score gap may be defined as the difference between two skill scores $s_i$ and $s_j$. The expected skill score gap $E(s_i-s_j)$ or $E[(s_i-s_j)^2]$ may be determined using:

$$E[|s_i - s_j|] = 2\sigma_{ij}^2 N(\mu_{ij}; 0, \sigma_{ij}^2) + \mu_{ij}\left(2\Phi\left(\frac{\mu_{ij}}{\sigma_{ij}}\right) - 1\right) \tag{106}$$

or $$E\lfloor(s_i - s_j)^2\rfloor = \mu_{ij}^2 + \sigma_{ij}^2 \tag{107}$$

where $\mu_{ij}$ is the difference in the means of the players (i.e., $\mu_{ij}=\mu_i-\mu_j$) and where $\sigma_{ij}^2$ is the sum of the variances of the players i and j (i.e., $\sigma_{ij}^2=\sigma_j^2+\sigma_j^2$). The expectation of the gap in skill scores may be compared to a predetermined threshold to determine if the player i and j should be matched. For example, the predetermined threshold may be in the range of approximate 3 to approximately 6, and may depend on many factors including the number of players available for matching. More particularly, the more available players, the lower the threshold may be set.

Moreover, the skill score belief of player i can be used to compute a conservative skill score estimate as $u_i-l\sigma_j$ where l is a positive number that quantifies the level of conservatism. Any appropriate number for l may be selected to indicate the level of conservatism, such as the number 3, may be used for leaderboards. The advantage of such a conservative skill score estimate is that for new players, the estimate it can be zero (due to the large initial variance $\sigma_i^2$) which is often more intuitive for new players ("starting at zero").

Having now described some illustrative embodiments of the invention, it should be apparent to those skilled in the art that the foregoing is merely illustrative and not limiting, having been presented by way of example only. Numerous modifications and other illustrative embodiments are within the scope of one of ordinary skill in the art and are contemplated as falling within the scope of the invention. In particular, although the above example are described with reference to modeling the prior and/or the posterior probability with a Gaussian, it is to be appreciated that the above embodiments may be expanded to allowing arbitrary distributions over players' skill scores, which may or may not be independent. Moreover, although many of the examples presented herein involve specific combinations of method operations or system elements, it should be understood that those operations and those elements may be combined in other ways to accomplish the same objectives. Operations, elements, and features discussed only in connection with one embodiment are not intended to be excluded from a similar role in other embodiments. Moreover, use of ordinal terms such as "first" and "second" in the claims to modify a claim element does not by itself connote any priority, precedence, or order of one claim element over another or the temporal order in which operations of a method are performed, but are used merely as labels to distinguish one claim element having a certain name from another element having a same name (but for use of the ordinal term) to distinguish the claim elements.

Figure 10:
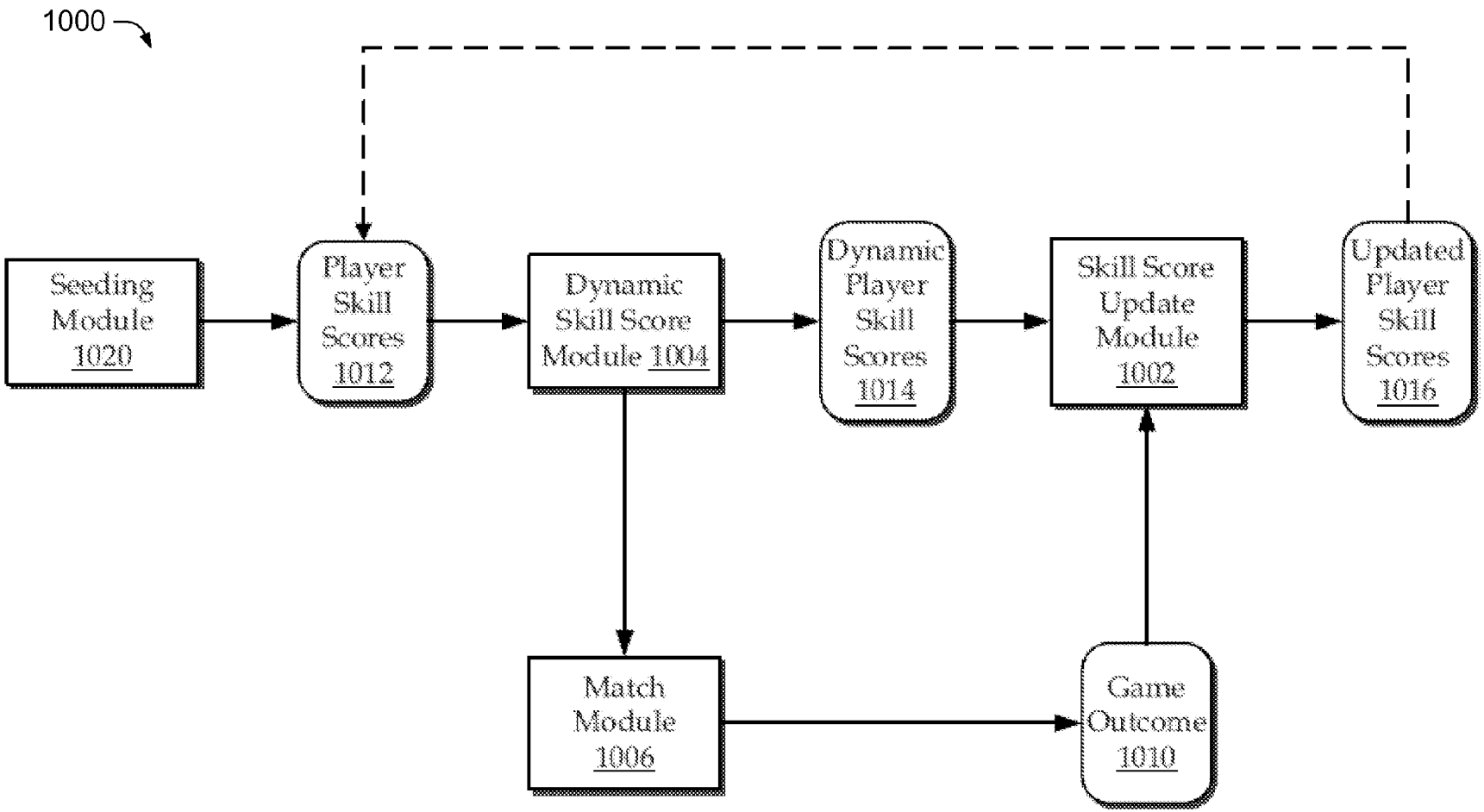
FIG. 10 illustrates an example system for seeding skill scores.

FIG. 10 illustrates an example system 1000 for seeding skill scores in a gaming environment. It should be understood that a skill scoring system may have many applications, including without limitation. matching compatible players on the same team and matching opposing players or teams to obtain an evenly-matched competition. A gaming environment can represent various aspects of game play, including without limitation individual game titles or game modes (e.g., multi-player mode versus campaign mode).

Rather than simply setting a player's initial skill scores to a predefined value (e.g., $\mu$=1200 and $\sigma$=400), the skill scoring system 1000 initializes a player's skill score in a new game environment based on the player's skill scores from other ostensibly compatible gaming environments. As such, seeding skill scores may be based on a perceived relationship between a player's performance capabilities in multiple gaming environments—that a player's performances in other gaming environments can inform an initial estimate of the player's performance in the new gaming environment. For example, if the other gaming environments are auto racing game titles with similar controls, conditions, game play, etc., then one can infer that the player's skill scores in a new auto racing game titles could initially be similar to the player's skill scores in the other auto racing game titles.

The relative influence the player's performances in other gaming environments can have on the initial estimate for the new gaming environment can be varied depending on a compatibility factor between the games. For example, two auto racing games may have a compatibility factor of nearly 1 (e.g., 100%), whereas an auto racing game and a role playing game may have a compatibility factor of much less. The compatibility characteristic can be represented by a compatibility factor that can be set from gaming-environment-to-gaming-environment (e.g., game title or game mode) or for individual game parameters (e.g., speed, accuracy, strategy, etc.).

In one implementation, a player's skill scores from one or more other gaming environments (e.g., game titles or game modes) are input to a seeding module 1020, which influences initial skill scores for that player in a new gaming environment (e.g., a new game title or mode). For example, where a player's skill scores from one previous gaming environment are represented by $\mu_{seed}$ and $\sigma_{seed}$, the new gaming environment has base skill scores represented by $\mu_{base}$ and $\sigma_{base}$, and a compatibility factor between the two gaming environments is given by $\rho$, then the initial skill scores for that player in the new gaming environment can be computed as a linear interpolation between the base skill scores and the seed skill scores, based on the compatibility factor (although, it should be understood that other algorithms for computing the initial skill scores based on one or more seed skill scores may be employed):

$$\mu_{initial} = \frac{(1-\rho)\mu_{base}\sigma^2_{seed} + \rho\mu_{seed}\sigma^2_{base}}{(1-\rho)\sigma^2_{seed} + \rho\sigma^2_{base}} \tag{108}$$

$$\sigma^2_{initial} = \frac{\sigma^2_{seed}\sigma^2_{base}}{(1-\rho)\sigma^2_{seed} + \rho\sigma^2_{base}} \tag{109}$$

The compatibility factor can be developed through a variety of methods, including manual input by a game developer, user, etc. In another implementation, game developers may put their game environments into specific categories, wherein each category has a compatibility factor designated between it and another category as well as a compatibility factor for a pair of games within the same category. In yet another implementation, each game environment may be characterized by a set of developer-provided parameters for a variety of characteristics, such as speed, strategy, team play, accuracy, etc. The seeding module 1020 evaluates these parameters with corresponding parameters of another game environment to develop a compatibility factor between the gaming environments.

In at least one example implementation, seed skill scores and compatibility factors from multiple gaming environments may be blended to initialize a player's skill scores in a new gaming environment. To determine $(\mu_i)_{seed}$ and $(\sigma_i^2)_{seed}$ for a new given gaming environment i (such as a game title or a game mode) based on seed skill scores $(\mu_1, \sigma_1, \rho_1), \ldots, (\mu_k, \sigma_k, \rho_k)$ from multiple gaming environments, where each $\rho$ in a triplet represents the compatibility factor between the new gaming environment and the corresponding seed gaming environment.

In this context, each compatibility factor $\rho$ represents a weight by which some a-priori defined skill is used for the seeding gaming environment, and the formulation $$\sum_{j \neq i} \rho_j$$

represents an effective weight applied to all of the seed skill scores of the multiple gaming environments. Therefore, in one example implementation, the skill score with the highest compatibility factor of the set of gaming environments (relative to the new gaming environment) is chosen to compute the initial skill scores using Equations (108) and (109).

The seed skill scores from the multiple gaming environments can be blended. For example, let $$\tau_j := \frac{\mu_j}{\sigma_j^2} \text{ and } \pi_j := \frac{1}{\sigma_j^2}$$

for all $j \in \{1, \ldots, k\}$. Then a weighted average in $(\tau, \pi)$ space may be determined as follows:

$$\tau = \frac{1}{k}\sum_{j=1}^{k} \rho_j \tau_j$$

$$\pi = \frac{1}{k}\sum_{j=1}^{k} \rho_j \pi_j$$

Solving for the seed skill scores of gaming environment i yields:

$$(\sigma_i^2)_{seed} = \frac{1}{\pi_i} = \frac{1}{\frac{1}{k}\sum_{j=1}^{k} \rho_j \pi_j} \tag{110}$$

$$(\mu_i)_{seed} = \tau_i(\sigma_i^2)_{seed} = \frac{\sum_{j=1}^{k} \rho_j \tau_j}{\sum_{j=1}^{k} \rho_j \pi_j} \tag{111}$$

Therefore, the blended seed skill scores may be used to compute the initial skill scores for the player in the new gaming environment (e.g., using Equations (108) and (109).

Furthermore, in one implementation, the skill scoring system 1000 may require that the player's skill scores from the other gaming environments be mature enough to have been refined based on the player's performances over time in the other gaming environments. In one implementation, the skill scoring system 1000 may simply accept any skill scores from other gaming environments and assume they are mature enough to provide accurate information on the player's skills. In an alternative implementation, the skill scoring system 1000 may set a threshold of the number of games or hours played, below which a skill score for that gaming environment is not used in a seeding operation. Likewise, the skill scoring system 1000 may simply omit any skill scores from gaming environments that are not "compatible enough" with the new gaming environment (e.g., do not have a high enough compatibility factor).

The skill scoring system 1000 of FIG. 10 includes a seeding module 1020, which receives one or more seed skill scores for a player determined from other gaming environments and computes an initial skill score for the player with reference to a new gaming environment. Whether a single pair of seed skills scores is used or a blended seed score pair for gaming environment i computing using Equations (110) and (111), the initial skill score may be computed, such by using Equations (108) and (109).

The initial skill scores are stored as skill scores 1012. The skill scoring system 1000 of FIG. 10 also includes skill score update module 1002, which accepts the outcome 1010 of a game between two or more players. It should be appreciated that the game outcome may be received through any suitable method. For example, the outcome may be communicated from the player environment, such as an on-line system, to a central processor to the skill scoring system in any suitable manner, such as through a global communication network. In another example, the skill scores of the opposing player(s) may be communicated to the gaming system of a player hosting the skill scoring system. In this manner, the individual gaming system may receive the skill scores of the opposing players in any suitable manner, such as through a global communication network. In yet another example, the skill scoring system may be a part of the gaming environment, such as a home game system, used by the players to play the game. In yet another example, the game outcome(s) may be manually input into the skill scoring system if the gaming environment is unable to communicate the game outcome to the skill scoring system, e.g., the game is a 'real' world game such as board chess.

The game outcome 1010 may be an identification of the winning team, the losing team, and/or a tie. For example, if two players (player A and player B) oppose one another in a game, the game outcome may be one of three possible results, player A wins and player B loses, player A loses and player B wins, and players A and B draw. Each player has a skill score 1012, which may be updated to an updated skill score 1016 in accordance with the possible change over time due to player improvement (or unfortunate atrophy) and the outcome of the game by both the dynamic skill score module 1014 and the skill score update module 1002. More particularly, where the player skill score 1012 is a distribution, the mean and variance of each player's skill score may be updated in view of the outcome and the possible change over time due to player improvement (or unfortunate atrophy). The dynamic skill score module 1004 allows the skill score 1012 of one or more players to change over time due to player improvement (or unfortunate atrophy). The skill score update module 1002, through the outcomes of games, learns the skill score of the player. The player may improve over time, thus, the mean may be increased and/or the variance or confidence in the skill score may be broadened. In this manner, the skill score of each player may be modified to a dynamic player skill score 1014 to allow for improvement of the players. The dynamic player skill scores 1014 may then be used as input to the skill score update module 1002. In this manner, the skill score of each player may be learned over a sequence of games played between two or more players.

The skill score of each player may be used by a player match module 1006 to create matches between players based upon factors such as player indicated preferences and/or skill score matching techniques. The matched players, with their dynamic player skill scores 1014 may then oppose one another and generate another game outcome 1010.

In some cases, to accurately determine the ranking of a number n of players, at least log(n!), or approximately n log(n) game outcomes may be evaluated. The base of the logarithm depends on the number of unique game outcomes between the two players. In this example, the base is three since there are three possible game outcomes (player A wins, player A lose, and draw). This lower bound of evaluated outcomes may be attained only if each of the game outcomes is fully informative, that is, a priori, the outcomes of the game have a substantially equal probability. Thus, in many games, the players may be matched to have equal strength to increase the knowledge attained from each game outcome. Moreover, the players may appreciate a reasonable challenge from a peer player.

It is to be appreciated that although the dynamic skill score module 1004, the skill score update module 1002, the player match module 1006 are discussed herein as separate processes within the skill scoring system 1000, any function or component of the skill scoring system 1000 may be provided by any of the other processes or components. Moreover, it is to be appreciated that other skill scoring system configurations may be appropriate. For example, more than one dynamic skill scoring module, skill score update module, and/or player match module may be provided. Likewise, more than one database may be available for storing skill score, rank, and/or game outcomes. Any portion of the modules of the skill scoring system may be hard coded into software supporting the skill scoring system, and/or any portion of the skill scoring system 1000 may provided by any computing system which is part of a network or external to a network.

Figure 11:
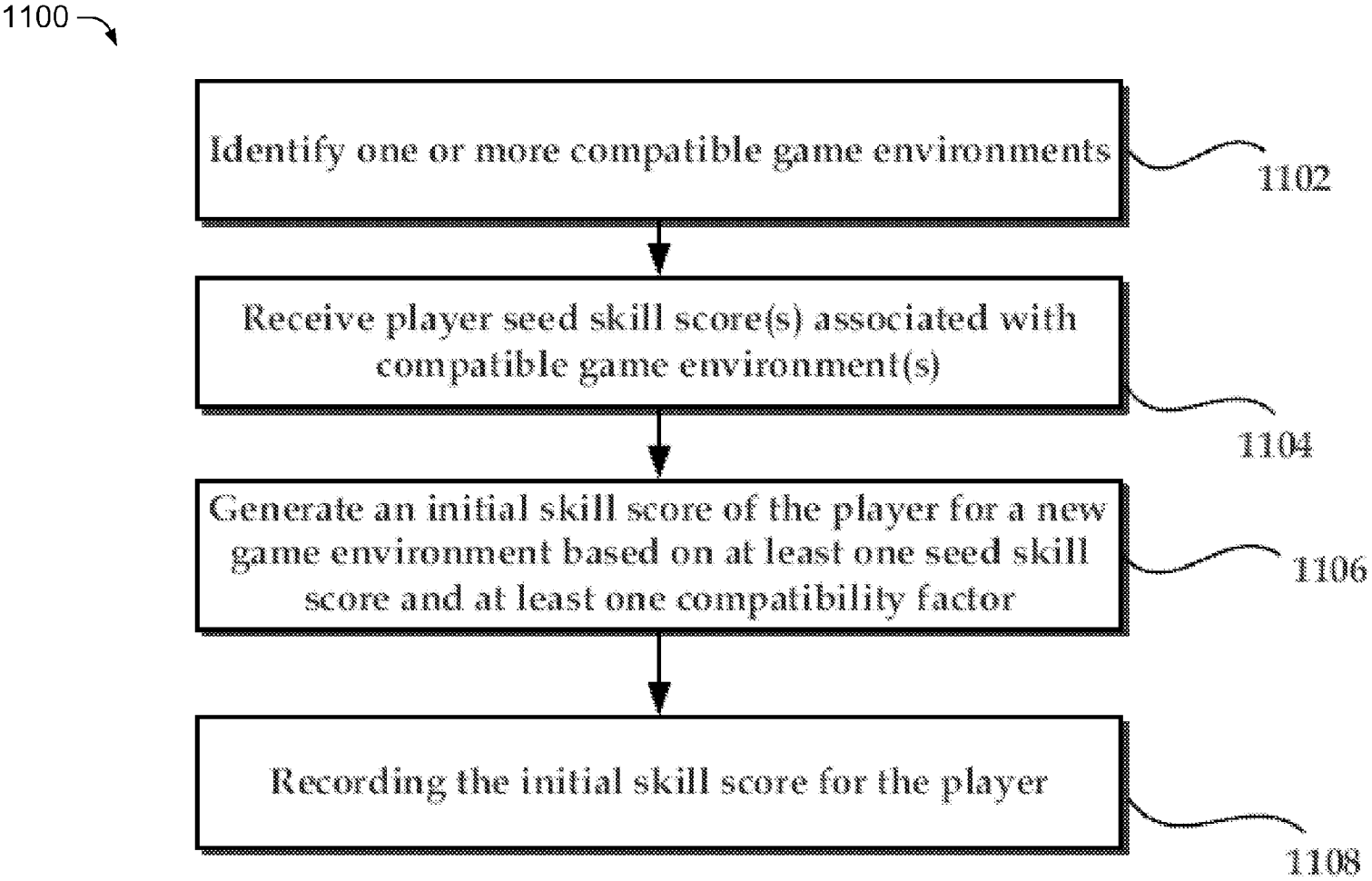
FIG. 11 illustrates example operations for seeding skill scores.

FIG. 11 illustrates example operations 1100 for seeding skill scores. The operations 1100 are executed to generate initial skill scores for the player in a new gaming environment. An identifying operation 1102 identifies one or more compatible gaming environments (i.e., relative to the new game environment) that are associated with skill scores for the player. These skill scores from the other gaming environments are used to seed the initial skill scores for the new gaming environment. In various implementations, compatibility between pairs of gaming environments is defined by individual compatibility factors available to or computed by the skill scoring system. For example, in one implementation, a seeding table of triplets $(\mu_1, \sigma_1, \rho_1), \ldots, (u_k, \sigma_k, \rho_k)$ is generated, where each compatibility factor $\rho_j$ represents a degree of compatibility between the new gaming environment i and the j-th gaming environment. Accordingly, $(\mu_i, \sigma_i, \rho_i)$ represent the initial skill scores for a given gaming environment independent of other gaming environments.

The identifying operation 1102 may also filter gaming environments, so that certain categories of gaming environments are excluded. For example, if a player has not played one of the gaming environments a sufficient number of times to develop a mature skill score in that gaming environment, then the identifying operation 1102 may omit that gaming environment. Likewise, if the compatibility between one of the gaming environments and the new gaming environment is below a certain threshold, the identifying operation 1102 may omit that gaming environment.

A seed score operation 1104 receives the seed skill score(s) associated with the identified compatible game environment(s). If there is only one gaming environment, then the seed skill scores and compatibility factor may be used directly in a generation operation 1106 to generate the initial skill scores for the new gaming environment (e.g., using Equations (108) and (109)). If more than one gaming environments is identified in the identifying operation 1102, then the multiple seed skill scores may be blended in a generation operation 1106 (e.g., using equations (110) and (111)) and then used to compute the initial skill scores for the new gaming environment (e.g., using Equations (108) and (109)).

Once computed, the initial skill scores for the player are recorded by a recording operation 1108 in a storage medium for access during or in preparation for game play in the new gaming environment. After the initialization of the skill score for the new gaming environment, the player's skill scores in this gaming environment can be updated as described with regards to FIGS. 2 and 10.

What is claimed is:

1. A method implemented by a computing device, the method comprising:

receiving a first seed skill score for a first game that has previously been played by a player, the first seed skill score reflecting one or more scores by the player in the first game; and determining an initial skill score of the player for a new game based on at least the first seed skill score of the player for the first game, wherein the new game and the first game are different games that are related by a compatibility factor reflecting compatibility between the first game and the new game.

2. The method according to claim 1, further comprising:

recording the initial skill score of the player in a storage device in association with the new game.

3. The method according to claim 1, further comprising:

determining the initial skill score as a blended skill score based on the first seed skill score and another seed skill score for another game.

4. The method according to claim 1, wherein the first seed skill score comprises a first seed average score reflecting an average score of the player in the first game and a first seed confidence level reflecting a distribution of scores by the player in the first game.

5. The method according to claim 4, wherein:

the initial skill score comprises an initial average score and an initial confidence level, and the determining comprises determining the initial average score based on the first seed average score and determining the initial confidence level based on the first seed confidence level.

6. The method according to claim 4, wherein the first seed average score comprises a mean and the first seed confidence level comprises a variance.

7. The method according to claim 1, further comprising:

determining whether another compatibility factor reflecting compatibility between the first game and another new game is below a threshold, and when the another compatibility factor is below the threshold, omitting the first seed skill score when determining another initial skill score for the another game.

8. The method according to claim 1, wherein the first game comprises an auto racing game title and the new game comprises a different auto racing game title.

9. The method of claim 1, wherein determining the initial skill score comprises using the compatibility factor to interpolate between a base skill score for the new game and the seed skill score.

10. A system comprising:

a seeding module configured to:

receive a first seed skill score for a first game that has previously been played by a player, the first seed skill score reflecting one or more scores by the player in the first game, and determine an initial skill score of the player for a new game based on at least the first seed skill score of the player for the first game, wherein the new game and the first game are different games that are related by a compatibility factor reflecting compatibility between the first game and the new game; and a processing unit of a computing device, the processing unit being configured to execute the seeding module.

11. The system according to claim 10, further comprising a storage device configured to store the initial skill score in association with the new game.

12. The system according to claim 10, wherein the first game and the new game comprise different game titles.

13. The system according to claim 10, wherein the seeding module is further configured to evaluate a set of parameters for the new game and a different set of parameters for the first game to determine the compatibility factor.

14. The system according to claim 13, wherein at least one of the set of parameters or the different set of parameters comprise developer-provided parameters.

15. A memory device or storage device comprising executable instructions which, when executed by at least one processing unit of a computing device, cause the at least one processing unit to perform acts comprising:

receiving a first seed skill score for a first electronic game that has previously been played by a player, the first seed skill score reflecting one or more scores by the player in the first electronic game; and determining an initial skill score of the player for a new electronic game based on at least the first seed skill score of the player for the first electronic game, wherein the new electronic game and the first electronic game are different games that are related by a compatibility factor reflecting compatibility between the first electronic game and the new electronic game.

16. The memory device or storage device of claim 15, wherein determining the initial skill score comprises using the compatibility factor and the first seed skill score to adjust a base skill score for the new game and thereby obtain the initial skill score.

17. The memory device or storage device of claim 16, the acts further comprising:

updating a skill score of the player for the new electronic game based on outcomes when the player plays the new electronic game, wherein the skill score starts as the initial skill score before being updated.

18. The memory device or storage device of claim 17, the acts further comprising:

receiving, over an electronic network, an outcome of the first electronic game for the player; and determining the first seed skill score based at least in part on the outcome.

19. The memory device or storage device of claim 18, wherein updating the skill score comprises applying a probabilistic inference algorithm to update a probabilistic distribution for the skill score.

20. The memory device or storage device of claim 19, wherein the probabilistic inference algorithm is a Bayesian inference algorithm and the probabilistic distribution is a Gaussian distribution.

21. The memory device or storage device of claim 15, wherein determining the initial skill score comprises using the compatibility factor to interpolate between a base skill score for the new game and the seed skill score.

* * * * *